US005904204A

United States Patent [19]

Teraoka et al.

[11] Patent Number: 5,904,204

[45] Date of Patent: May 18, 1999

[54] APPARATUS FOR PRODUCING STRIP OF STAINLESS STEEL

[75] Inventors: Shinichi Teraoka; Toshiyuki Suehiro; Eiichirou Ishimaru, all of Hikari; Tetsurou Takeshita, Kitakyushu; Shunji Shoda, Futtsu; Takashi Arai; Hideki Oka, both of Hikari; Yoshikatsu Nohara, Futtsu, all of Japan

[73] Assignee: Nippon Steel Corporation, Tokyo, Japan

[21] Appl. No.: 08/750,188

[22] PCT Filed: Apr. 12, 1996

[86] PCT No.: PCT/JP96/01027

§ 371 Date: Dec. 3, 1996

§ 102(e) Date: Dec. 3, 1996

[87] PCT Pub. No.: WO96/32507

PCT Pub. Date: Oct. 17, 1996

[30] Foreign Application Priority Data

Apr. 14, 1995 [JP] Japan ..... 7-089825
Jul. 26, 1995 [JP] Japan ..... 7-189988

[51] Int. Cl.[6] ..... B22D 11/12; B22D 11/66; C21D 9/54

[52] U.S. Cl. ..... 164/417; 164/423; 164/428; 164/415; 266/103

[58] Field of Search ..... 164/476, 477, 164/480, 485, 486, 417, 423, 428, 415; 29/527.7; 266/102, 103

[56] References Cited

U.S. PATENT DOCUMENTS 4,494,929 1/1985 Fujioka et al. ..... 266/102
5,584,337 12/1996 Nakashima et al. ..... 164/476
5,634,257 6/1997 Kajiwara et al. ..... 29/527.7

FOREIGN PATENT DOCUMENTS 0638653 2/1995 European Pat. Off. .
60-255931 12/1985 Japan .
62-136526 6/1987 Japan .
1-130802 5/1989 Japan .
2-133528 5/1990 Japan .
2-166233 6/1990 Japan .
2-263930 10/1990 Japan .
4-26722 1/1992 Japan .
1696522 of 0000 U.S.S.R. .

OTHER PUBLICATIONS

Zairyo to Purosesu (Current Advances in Materials and Processes), vol. 3, 1990, p. 770.

Zairyo to Purosesu (Current Advances in Materials and Processes), 1991, vol. 4, p. 996.

Zairyo to Purosesu (Current Advances in Materials and Processes), 1991, vol. 4, p. 997.

*Primary Examiner*—Patrick Ryan
*Assistant Examiner*—I.-H. Lin
*Attorney, Agent, or Firm*—Kenyon & Kenyon

[57] ABSTRACT

An apparatus for the production of a stainless steel strip comprising the following devices provided in sequence: a twin-drum continuous casting machine; an atmosphere control cover having in its interior a bridle roll or a pinch roll; a hot-rolling machine; a heat-treating furnace comprising direct fire burners connected to header pipes juxtaposed to one another in the widthwise direction of the furnace over the longitudinal direction of the furnace; a cooler; and a coiler.

10 Claims, 15 Drawing Sheets

APPARATUS FOR PRODUCING STRIP OF STAINLESS STEEL

CROSS-REFERENCE TO RELATED APPLICATION

This application is a 371 of PCT/JP96/01027, filed on Apr. 12, 1996.

TECHNICAL FIELD

The present invention relates to an apparatus wherein a stainless steel is cast into a thin strip-like slab, having a thickness of not more than 10 mm, which is then hot-rolled to a steel sheet product. In particular, the present invention relates to an apparatus for the production of a stainless steel strip having an excellent surface quality.

BACKGROUND ART

A technique where a molten steel is cast directly into a thin strip-like slab having a thickness of not more than 10 mm has recently been developed and tested using actual equipment. This new technique can simplify or eliminate the step of hot rolling.

A slab having a thickness exceeding 100 mm has hitherto been hot-rolled by means of a hot-rolling mill, consuming much energy. Therefore, the simplification or elimination of the step of hot rolling has been desired from the viewpoint of lower production costs as well as of the environment. The process involving the step of casting a molten steel into a thin strip-like slab having a thickness of not more than 10 mm will be hereinafter referred to as the "new process," while a process involving the step of hot-rolling a slab to a thin strip-like slab will be hereinafter referred to as the "current process."

The production of a cold-rolled sheet of a Cr-Ni-base stainless steel, represented by a 18%Cr-8%Ni steel, or a Cr-base stainless steel by the new process has posed a problem of surface roughening (called "orange peel" or "roping") created on the surface of products.

For example, an article in ZAIRYO TO PUROSESU (Current Advances in Materials and Processes) Vol. 3 (1990), p. 770, published by The Iron and Steel Institute of Japan describes a phenomenon of deterioration in surface quality of sheet products of SUS304 produced by the new process. According to this article, orange peel-like surface roughening (roping) is described to be created on the surface of a cold-rolled steel sheet due to the presence of coarse grains in the material before finish cold rolling. In order to prevent this phenomenon, the refinement of grains of the material before the finish cold rolling by the following two means is described to be useful.

1) The thin strip-like slab is subjected to hot rolling and annealing of the hot-rolled sheet. For example, it is hot-rolled at 1200° C. with a reduction ratio of 16% and subjected to solution treatment at 1150° C. for one min.
2) The thin strip-like slab is subjected to cold rolling twice with intermediate annealing being performed therebetween. For example, it is rolled at room temperature with a reduction ratio of 10% and subjected to intermediate annealing and then to finish rolling.

Further, an article in ZAIRYO TO PUROSESU (Current Advances in Materials and Processes) Vol. 4 (1991), p. 996, discloses that, although the surface roughening (roping) of a cold-rolled sheet can be alleviated by subjecting the cold-rolled sheet to temper rolling with a high reduction ratio, this technique deteriorates the quality, particularly the elongation, of the material, necessitating the regulation of the steel composition so as to be brought to a γ-phase unstable composition system, i.e., high Md30. For example, it describes that roping and workability (elongation) can be made comparable with those in the case of the current process by bringing Md30 to 30° C. and conducting temper rolling with a reduction ratio of 1%.

Furthermore, an article in ZAIRYO TO PUROSESU (Current Advances in Materials and Processes) Vol. 4 (1991), p. 997 describes that the surface roughening (roping) of a cold-rolled sheet can be alleviated by designing the constituents so as to increase the δ-ferrite content, thereby providing a γ-phase unstable composition.

Furthermore, Japanese Unexamined Patent Publication (Kokai) No. 2-133528 describes that hot rolling, at a temperature of 900° C. or above, with a reduction ratio of not more than 60% results in the recrystallization of the texture of the thin strip-like slab, alleviating roping. This technique is described to alleviate the roping independently of the practice of annealing after hot rolling. Further, regarding the heat history of the strip after hot rolling, the document describes only that the strip is cooled in the temperature range of 900 to 550° C. at a rate of not less than 50° C./sec.

Regarding the production of a sheet of a Cr-base stainless steel having reduced ridging by a thin strip-like slab casting process, Japanese Unexamined Patent Publication (Kokai) No. 2-166233 discloses a production process which comprises the steps of: casting a steel into a thin strip-like slab having a thickness of not more than 10 mm; subjecting the thin strip-like slab to rolling with a reduction ratio of not less than 20% at a temperature above the γ-phase precipitation initiation temperature; immediately after the rolling, introducing the resultant steel sheet into a soaking pit and holding in the above temperature region for 3 sec to 5 min; and then subjecting the steel sheet to coiling, cold rolling, and annealing.

Further, in order to prevent ridging of a C-base stainless steel strip, Japanese Unexamined Patent Publication (Kokoku) No. 62-136526 discloses a process which comprises the steps of: casting a steel into a thin strip-like slab having a thickness of not more than 60 mm; holding the slab in the temperature range of 900 to 1150° C. for 5 min or longer; hot-rolling the slab with final hot rolling being conducted at 800 to 1100° C.; and then subjected to a series of conventional steps, i.e., annealing, picking, cold rolling, and finish rolling.

Further, with a view to improving the toughness of a sheet of Cr-base stainless steel, EP 0638653 A1 discloses a technique where a thin strip-like slab having a thickness of not more than 10 mm is hot-rolled in the temperature range of 1150 to 950° C. with a reduction ratio of 5 to 40% and then passed through a heat-treating furnace, kept in that temperature region, over a period of 5 sec or longer, to permit carbonitride or the like contained in the rolled strip to be satisfactorily precipitated and grown.

In the above known publications, however, even when heat treatment is performed after hot rolling of the thin cast strip-like slab in order to improve the surface quality, no means for the heat treatment is specifically disclosed. Similarly, in the case of a technique where, after hot rolling, heat treatment is performed in order to improve the toughness, no means for the heat treatment is specifically disclosed.

Further, none of the above known publications disclose means for solving problems caused in direct rolling of the thin strip-like cast slab, such as meander, breaking, and creation of defects such as scab.

Furthermore, none of the above known publications propose means for alleviating the creation of roping due to uneven heat treatment caused in the case where the thickness of the thin cast strip-like slab is changed during casting.

An object of the present invention is to solve the above various problems caused in the production of sheet products using a continuous thin cast strip-like slab.

Another object of the present invention is to solve problems, associated with the surface quality, caused in the production of sheet products from a continuous thin cast strip-like slab.

A further object of the present invention is to provide an apparatus which enables a continuous thin cast strip-like slab to be stably rolled by means of a rolling machine connected directly with a casting machine.

A yet further object of the present invention is to provide a heat-treating furnace which can heat an as-rolled thin strip-like slab evenly in the widthwise direction.

A yet further object of the present invention is to provide an apparatus, for the production of a steel sheet, which can produce a steel sheet product without causing roping even when the sheet thickness has been changed during casting.

CONSTRUCTION OF INVENTION

The present inventors have found that the refinement of grains of a thin strip-like slab is most effective for reducing the problem of roping caused in the casting of a stainless steel into a thin strip-like slab. Accordingly, the present invention relates to a technique where a thin strip-like slab is directly hot-rolled to create cracks in grains and then heat-treated to refine the grains.

The construction of the present invention for realizing the above technique is as follows.

At the outset, a continuous casting machine of a twin drum type is provided wherein a molten stainless steel, such as a molten Cr-Ni-base stainless steel or a molten Cr-base stainless steel, is cast into a thin strip-like slab having a thickness of not more than 10 mm. In this casting machine, the wall surface of a mold defined by twin rolls is moved in synchronism with the resultant thin strip-like slab and functions to cool and solidify the molten steel, thereby forming a shell which is pressed by means of the twin roll to form a thin strip-like slab.

A hot rolling machine is installed in close vicinity to the continuous casting machine so that the thin strip-like slab prepared by the continuous casting machine is rolled while maintaining the slab temperature and in the temperature range of 900 to 1200° C. with a reduction ratio of not less than 10%. In order to maintain the thin strip-like slab in the above temperature range, a region between the continuous casting machine and the hot rolling machine is covered with an atmosphere control cover.

Two sets of pinch rolls or a bridle roll are provided within the atmosphere control cover. This enables a tension applied to the thin strip-like slab to be divided into a tension on the casting machine side (low tension) and a tension on the hot rolling machine side (high tension), and the application of suitable tension to the high-temperature thin strip-like slab enables the slab to be stably rolled to a desired thickness and can prevent meander, breaking and other unfavorable phenomena of the thin strip-like slab.

A heat-treating furnace is installed adjacent to the hot rolling machine. In the present invention, the interior of the heat-treating furnace is divided into a plurality of heating zones in the longitudinal direction thereof, and, in each heating zone, direct fire burners are disposed on an upper wall and a lower wall of the furnace so as to sandwich the hot-rolled strip, being passed through the furnace, between the burners provided on the upper wall and the burners provided on the lower wall. The direct fire burner is excellent in the capability of raising the temperature of the strip as well as in the response to the instruction of raising the temperature of the strip and can easily and surely conduct the temperature control of each zone, enabling the roping resistance to be satisfactory improved.

Further, the thickness of the strip is varied during casting, the length of the zone in the heat-treating furnace can be controlled according to the thickness of the strip. Therefore, in any case, heat treatment can be performed evenly in the widthwise direction of the strip, resulting in reduced roping and good surface luster.

The region between the hot rolling machine and the heat-treating furnace may be covered with a temperature-holding cover. In this connection, it should be noted that a strip thickness meter may be provided within the atmosphere control cover or the temperature-holding cover to conduct the regulation of the reduction ratio in the hot rolling machine, the regulation of rolling of a hot bar, or the control of the temperature in the heat-treating furnace.

A cooler is provided wherein the strip heat-treated in the heat-treating furnace to refine grains is cooled at a rate of not less than 10° C./sec. A slit cooling header may be used as the cooler.

Further, a coiler for coiling the cooled strip is provided.

In the strip produced using the above apparatus, since the grains are evenly refined over the whole area of the strip, the strip can be descaled and then subjected to cold rolling and annealing-pickling or bright annealing to prepare a sheet product having markedly improved surface quality characteristics.

BEST MODE FOR CARRYING OUT THE INVENTION

In order to refine grains of a thin strip-like slab, hot rolling, by means of a hot-rolling machine connected directly to the casting machine, by taking advantage of the potential heat of the thin strip-like slab, followed by heat treatment in a heat-treating furnace connected directly to the rolling machine is most effective. Further, an atmosphere control cover is provided between the casting machine and the hot rolling machine to regulate the hot rolling temperature, or, if necessary, a temperature-holding cover may be provided between the hot rolling machine and the heat-treating furnace.

Thus, the cast thin strip-like slab is rolled while holding the casting heat and, if necessary, heating the thin strip-like slab, and the hot-rolled strip is then subjected to heat treatment necessary for recrystallization without lowering the temperature of the strip to 800° C. or below.

The above technique permits the recrystallization of the grains after rolling to proceed, and coiling of the strip at a low temperature accelerates the recrystallization to refine the grains, thus enabling the height of roping to be satisfactorily decreased.

Figure 3:
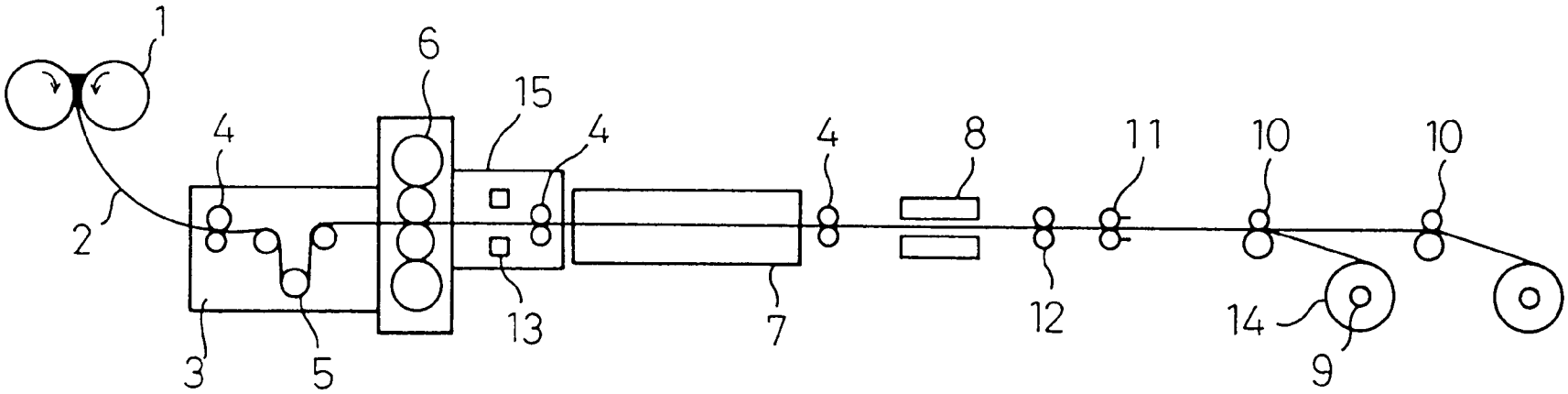
FIG. 3 is a schematic side view of the apparatus for the production of a stainless steel strip according to the present invention.

FIG. 3 is one embodiment of a twin-drum type thin strip-like slab continuous casting/rolling/heat treatment line according to the present invention. A thin strip-like slab 2 cast by means of a twin-drum type thin strip-like slab continuous casting machine 1 is, if necessary, heated within an atmosphere control zone 3 to regulate the temperature of the thin strip-like slab on the inlet side of a hot rolling machine 6.

The thin strip-like slab 2 is carried by means of a pinch roll 4 located under the twin drum, and the tension on the inlet side of the hot-rolling machine 6 is ensured by means of a bridle roll 5 provided downstream of the drums to prevent meander of the slab 2 created by rolling with a high reduction ratio.

One or two bridle rolls 5 or one set or two sets of pinch rolls 5-1 (see FIG. 7) are disposed within the atmosphere control zone 3. The installation of the tension controller on the inlet side of the hot rolling machine side is one of the features of the present invention.

The strip-like slab cast according to the present invention has a small thickness (not more than 10 mm) and a high temperature (900 to 1200° C.). Therefore, in order to apply even pressure over the whole area of the thin strip-like slab to evenly refine grains, the thin strip-like slab should be stably passed through the hot rolling machine. For this reason, a high tension (0.5 to 1.5 kg/mm$^2$), determined by taking into consideration the properties of the thin strip-like slab, is necessary. On the other hand, the tension applied to the thin strip-like slab in the casting step is created by a pulling force on the casting and, hence, should be low (0.1 to 0.5 kg/mm$^2$).

Further, in the twin-roll continuous casting line, for operational reasons, it is difficult to evenly maintain the solidification of the thin strip-like slab. The edge shape of the thin strip-like slab is not always identical and, in some cases, becomes uneven. In particular, as the present invention, when the twin-roll continuous casting machine is contiguous directly with the rolling machine, rolling with a high reduction ratio by means of the rolling machine is likely to cause elongation of the strip toward one side due to the influence of the unsymmetry of the shape of the thin strip-like slab and, at the same time, cause meander of the rolling material at the rolling machine inlet. The influence immediately leads to meander of the thin strip-like slab on the inlet side of the pinch roll located upstream of the hot rolling machine, and the thin strip-like slab in a catenary loop form under the twin roll is often turned up while causing twist vibration and comes into contact with a carrier guide, which is causative of a breaking trouble.

Therefore, in the present invention, predetermined tension should be applied to the thin strip-like slab under such an environment that the atmosphere is controlled at a high temperature, and a bridle roll or a pinch roll is provided for attaining this purpose.

The thin strip-like slab 2 is rolled by means of a hot rolling machine 6 with a reduction ratio in the range of from about 10 to 50%. Since the hot rolling is continuously performed, the thin strip-like slab rolled by thermal expansion of the rolling roll loses its shape, and more particularly undergoes center buckling, with the elapse of time. For this reason, a bender shape controller is provided in the hot rolling machine, or alternatively the construction is made so that the rolls in the course of flying are crossed. Further, since the rolling is continuously performed, there is a possibility that abrasion of the roll and/or heat cracking occurs. In order to avoid this unfavorable phenomenon, the construction is designed so that the rolls in the course of flying can be rearranged. A thickness meter 13 is disposed downstream of the hot rolling machine 6, and information on the thickness of the strip is fed back for control of the shape, and a holding cover 15 is provided in order to prevent the temperature of a hot-rolled strip 2*s* on the outlet side of the hot rolling machine 6 from being lowered. A heat-treating furnace 7 is provided continuously with the holding cover 15 and functions to control the temperature of the strip by means of a jet burner or a direct fire burner and to keep the oxygen concentration of the atmosphere at about 2 to 6%.

In the new process, the slab heating step, before hot rolling, conducted in the current process is completely eliminated. Further, since the thickness of the thin strip-like slab is small, the cooling rate after solidification is much higher than that of the slab in the current process. For this reason, in the slab formed by the current continuous casting, precipitates, such as MnS and $Cu_2S$, are present in a solid solution form. When the slab is hot-rolled in this state and cooled to a temperature of 800° C. or below without satisfactory recrystallization, fine precipitates are produced along dislocation introduced by hot rolling. For this reason, in order to provide a completely recrystallized texture in subsequent annealing of the hot-rolled sheet, the time necessary for the annealing is longer than that necessary for the heat treatment. From this fact, it can be said that heat treatment of the strip, immediately after hot rolling, without lowering the strip temperature to 800° C. or below to provide a completely recrystallized texture is useful for efficient recrystallization of the texture of the hot-rolled sheet.

The heat-treated strip is cooled in a cooling zone 8, provided on the outlet side of the heat-treating furnace, for example, by a slit cooling header, and cut by means of a shear 11 into a predetermined strip length. The strip is then continuously coiled by means of two coilers 9 to form a coil 14 while switching the coilers.

In the twin-roll continuous casting line, a stainless steel strip having no significant roping and a good surface luster is produced by the following method.

A thin strip-like slab having a thickness of not more than 10 mm is continuously cast by means of a twin-roll type continuous casting machine, hot-rolled with a reduction ratio of 10 to 50% in the temperature range of 900 to 1200° C., held in the temperature range of 900 to 1200° C. for 5 sec or longer, thereby conducting heat treatment, and coiled at a temperature of 600° C. or below to form a steel strip which is then descaled, cooled, and annealing/pickling or bright annealing. If necessary, the above process is followed by temper rolling.

When the strip after the heat treatment is cooled to a coiling temperature, it is cooled in the temperature range of 900 to 600° C. at a rate of preferably not less than 10° C./sec, more preferably not less than 20° C./sec. The rolling temperature is preferably in the range of from 1150 to 1000° C., and the temperature of the heat treatment after rolling is preferably in the range of from 1150 to 1050° C.

Hot rolling conditions and heat treatment conditions which greatly influence the roping phenomenon will be described in more detail.

The following experiment was carried out in order to provide optimal conditions for the hot rolling temperature and reduction ratio. Specifically, in a laboratory, SUS304 steel was cast into a thin strip-like slab having a thickness of 4 mm and hot-rolled in the temperature range of from 1250 to 850° C. with a reduction ratio of 5 to 50% to form a hot-rolled strip which was then passed through a heat-treating furnace, kept at 1000° C., for 5 sec, cooled, and coiled at a temperature of 600° C. or below. The strip was then descaled and cold-rolled with a reduction ratio of 50%. The resultant cold-rolled steel sheet was evaluated for roping on the surface thereof. The results are shown in FIG. 1.

Figure 1:
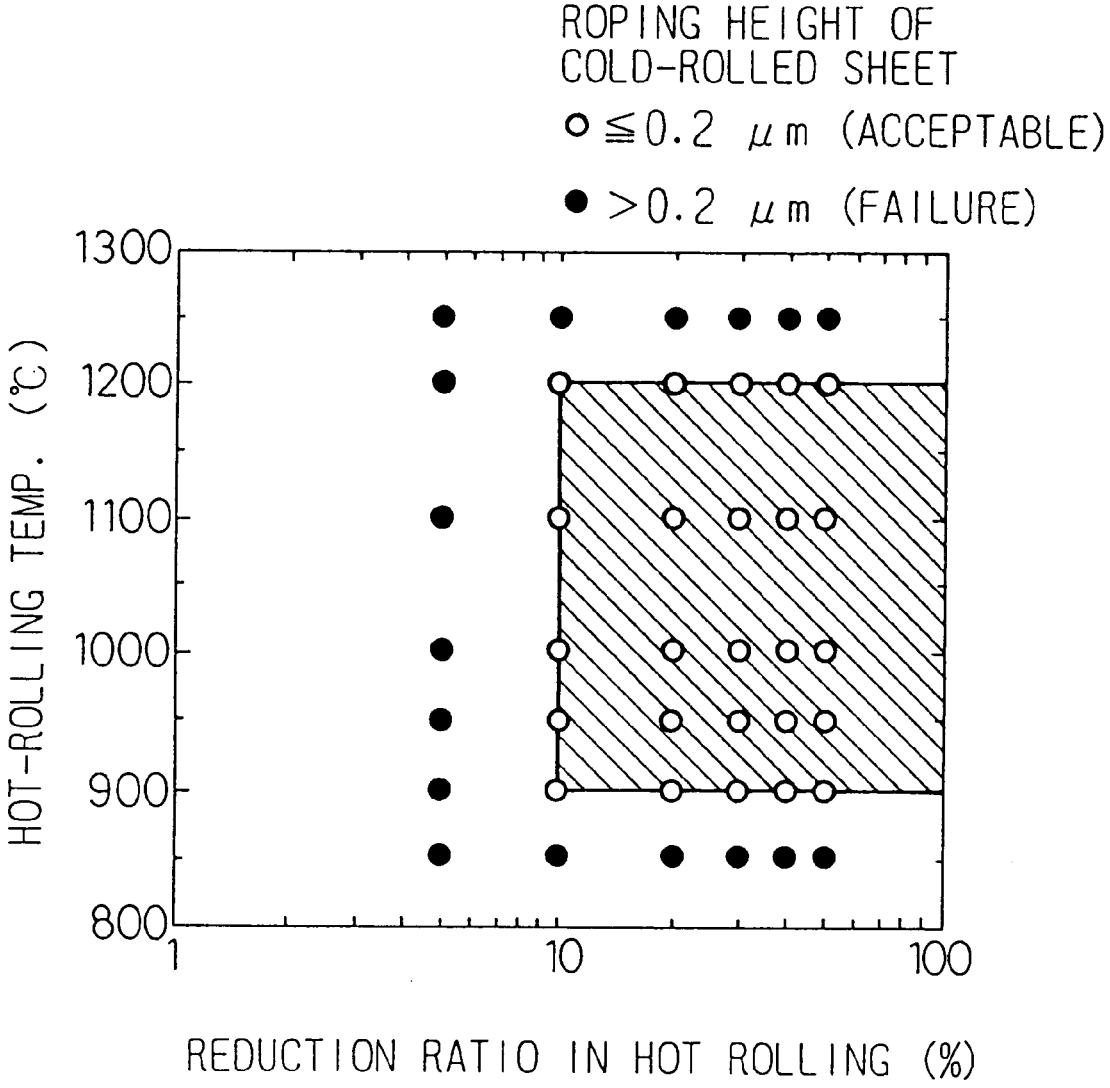
FIG. 1 is a diagram showing the relationship between the temperature and reduction ratio in hot rolling of a thin strip-like slab and the roping height of the resultant cold-rolled product.

As is apparent from FIG. 1, when the hot-rolling temperature is above 1200° C., the recrystallized grains are so coarse that the roping problem is not reduced. On the other hand, when the hot-rolling temperature is below 900° C., MnS and $Cu_2S$ are precipitated during hot rolling, inhibiting the recrystallization. Further, when the reduction ratio in the hot rolling is lower than 10%, no complete recrystallization texture could be created and roping occurred. Based on the above results, hot rolling is carried out in the temperature range of from 900 to 1200° C. with a reduction ratio of not less than 10%. However, in order to hot-roll the thin strip-like slab with a reduction ratio exceeding 50%, it is necessary to install a plurality of very large hot rolling machines, making it difficult to utilize the features of the new process. For this reason, the reduction ratio was limited to not more than 50%. Preferably, the reduction ratio is 20 to 40%, and the hot rolling temperature is 1000 to 1150° C.

Figure 2:
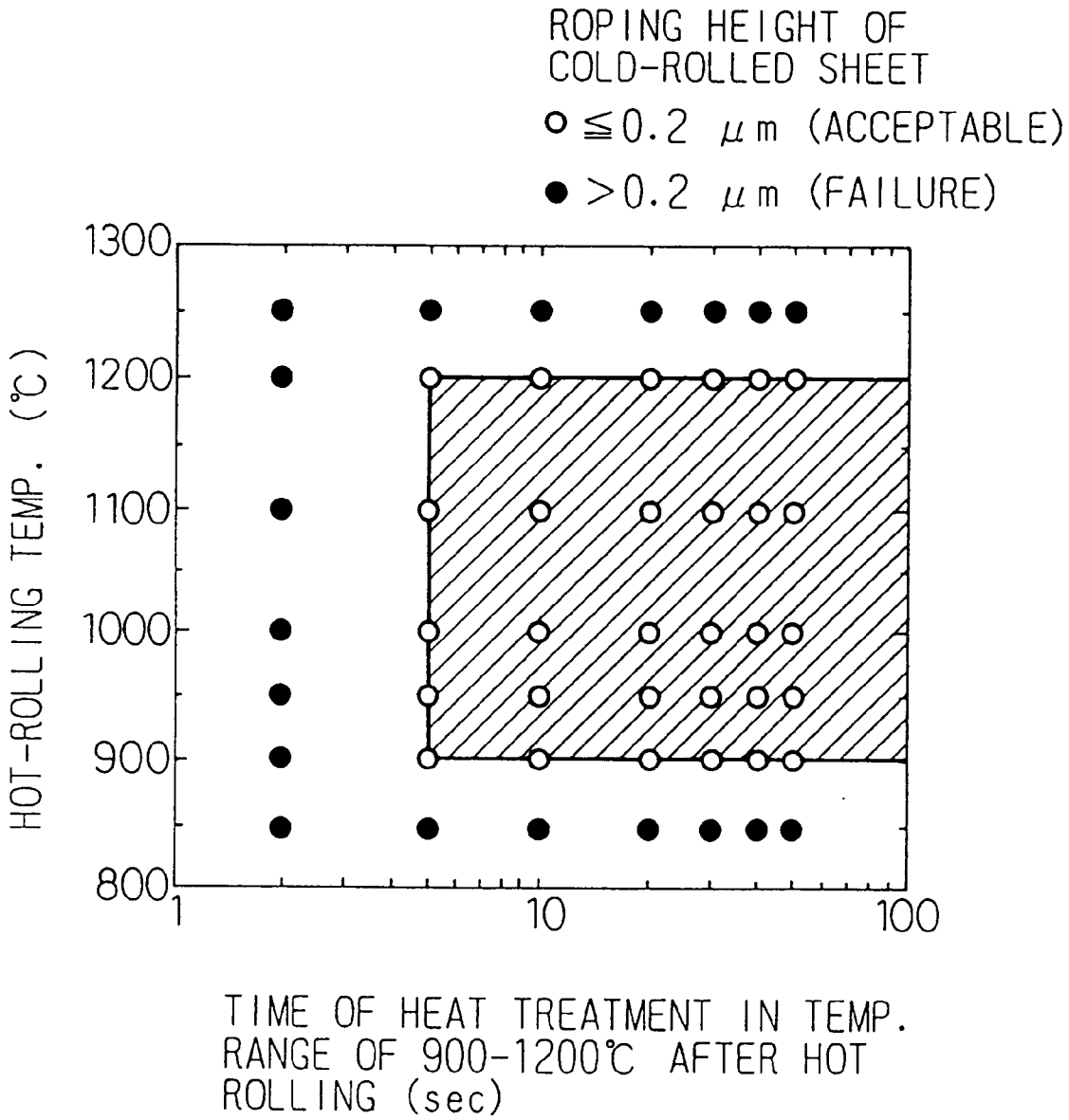
FIG. 2 is a diagram showing the relationship between the temperature and time of heat treatment conducted subsequently to hot rolling of a thin strip-like slab and the roping height of the resultant cold-rolled product.

Similarly, the following experiment was carried out in is order to establish conditions for heat treatment after hot rolling. Specifically, SUS304 steel was cast into a thin strip-like slab having a thickness of 4 mm which was then hot-rolled at 1100° C. with a reduction ratio of 20% to form a hot-rolled strip. Thereafter, the hot-rolled strip was held in the temperature range of from 1250 to 850° C. for 2 to 50 sec by taking advantage of induction heating. The strip was descaled and cold-rolled with a reduction ratio of 50%, and the resultant cold-rolled steel sheet was evaluated for roping on the surface thereof. The results are shown in FIG. 2. As is apparent from FIG. 2, when the hot-rolling temperature was above 1200° C., the recrystallized grains were coarsened, resulting in the creation of roping, while when it was below 900° C., the recrystallization did not proceed, here again resulting in the creation of roping. Also in the case of a heat treatment time shorter than 5 sec, roping occurred because complete recrystallization texture was not formed. Based on the above test results, heat treatment, after hot rolling, by holding the strip in the temperature range of 900 to 1200° C. for 5 sec or longer was found to be suitable. Preferably, the heat treatment temperature and time are 1150° C. and 10 to 30 sec, respectively.

Thus, the production of a thin strip-like slab using the apparatus of the present invention results in the formation of a stainless steel strip having excellent surface quality.

The heat-treating furnace according to the present invention will be described in more detail.

As described above, induction heating, a direct fire burner, a jet burner or the like is used as the heating means in the heat-treating furnace. Here, a heat-treating furnace will be described which uses a direct fire burner and, even when the thickness is changed in the course of casting, can conduct such proper heat treatment that recrystallized grains can be refined according to the change of the thickness.

In the thin strip-like slab continuous casting/hot rolling process, when thin strips of various sizes (thickness) are produced in a small lot, that the strip thickness can be changed during flying is preferred from the viewpoints of improved productivity, reduced production cost and the like.

Rolling conditions can be changed to cope with the change of the thickness of the thin strip-like slab during flying to some extent. However, when a basic premise is to produce stainless steel strips having stable quality (evaluated in terms of internal texture, luster, and the degree of roping), such means has its limit and, in this case, the change of the thickness of the thin strip-like slab too is considered necessary.

Figure 6B:
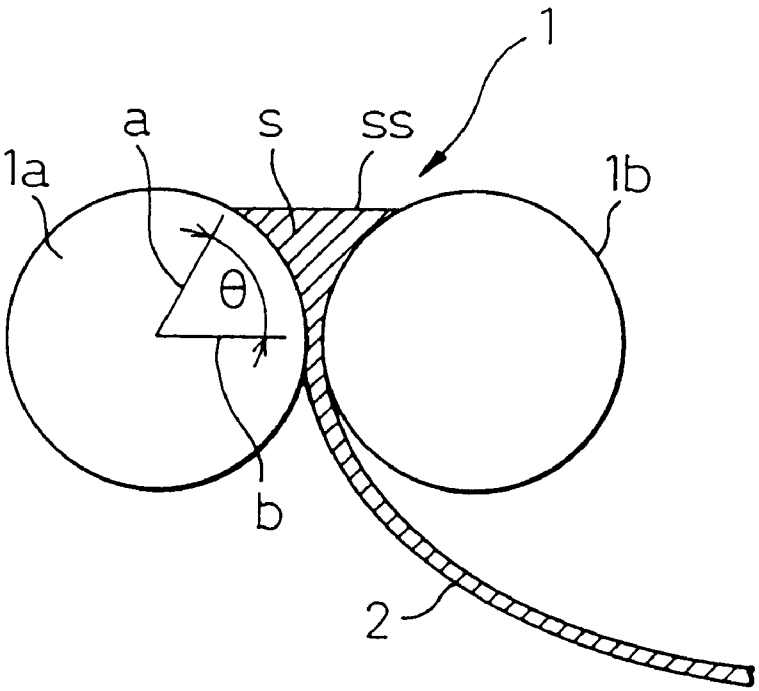
FIG. 6 (A) is a diagram showing the lower limit of the casting arc angle in continuous casting in the apparatus for the production of a strip according to the present invention, and FIG. 6 (B) is a diagram showing the upper limit of the casting arc angle.
Figure 6A:
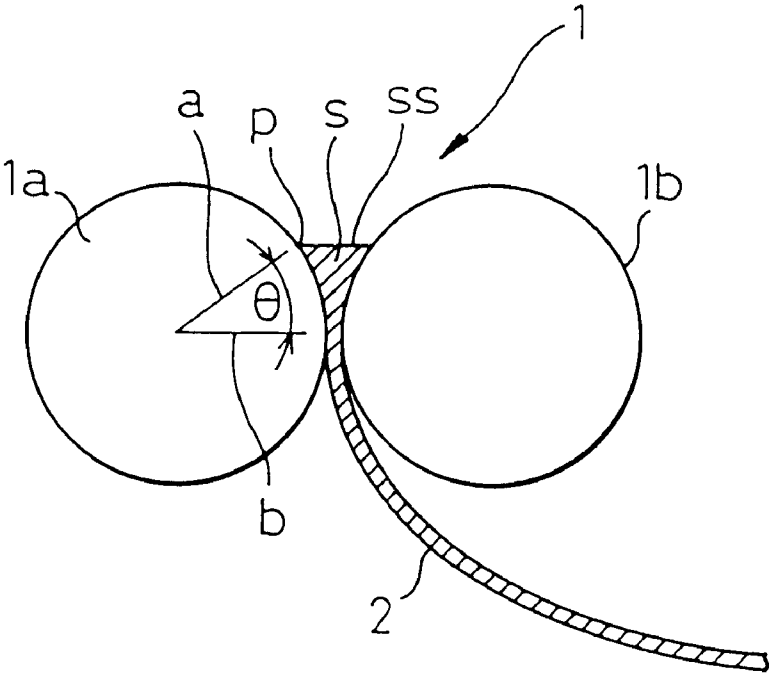

When the thickness of a thin strip-like slab to be produced is changed during flying to a smaller one in a twin-drum type continuous casting machine, the casting angle (an included angle θ, as shown in FIGS. 6 (A) and 6 (B), of a line a, formed by connecting a contact point p, between the circumferential surface of a drum 1*a* and the surface ss of a molten steel s, to the shaft center of the drum 1*a*, which makes with a horizontal line b formed by connecting the shaft centers of a pair of the drums 1*a*, 1*b*) is temporarily lowered to 20 to 30°. Since casting in this state renders the thickness of the formed shell unsatisfactory, the following method is used. Specifically, the casting speed is lowered, and, after a satisfactory shell is formed, the opening between the casting drums is reduced to form a thin strip-like slab, having a reduced thickness, which is then rolled by means of a hot rolling machine with a predetermined reduction ratio (30 to 50%), heat-treated in a heat-treating furnace at a predetermined temperature (in the range of from 900 to 1200° C. for 5 sec or longer), and cooled to 500 to 550° C. in a cooling zone at a predetermined cooling rate (20 to 90° C./sec). Thus, when the casting speed has been lowered, the heat treatment length of the heat-treating furnace and the cooling length of the cooling zone are reduced to respective predetermined lengths to prevent excessive heat treatment and supercooling. When the thickness of the thin strip-like slab has been decreased by reducing the opening between the drums resulting in increased casting speed, the heat treatment length in the heat-treating furnace and the cooling length in the cooling zone are changed to predetermined respective lengths to prevent lack of heat treatment and lack of cooling. Thus, even when the thickness of the thin strip-like slab has been changed during flying, proper heat treatment can be carried out, enabling the diameter of the fine recrystallized grains to be reduced to a predetermined value.

In the above case, when the casting arc angle is not more than 20°, it becomes impossible to conduct continuous casting. On the other hand, when it is not less than 30°, optimal control of heat treatment and cooling conditions becomes impossible. This renders the refinement of the grains unsatisfactory, resulting in lowered yield of the strip in transient period of the change in the thickness of the thin strip-like slab.

When the thickness of the thin strip-like slab is changed to a smaller one without controlling the casting arc angle, it may be changed by 0.1 to 1.0 mm which is expected to correspond to a change of the heat treatment length and the cooling length by 3 to 45%.

Figure 4:
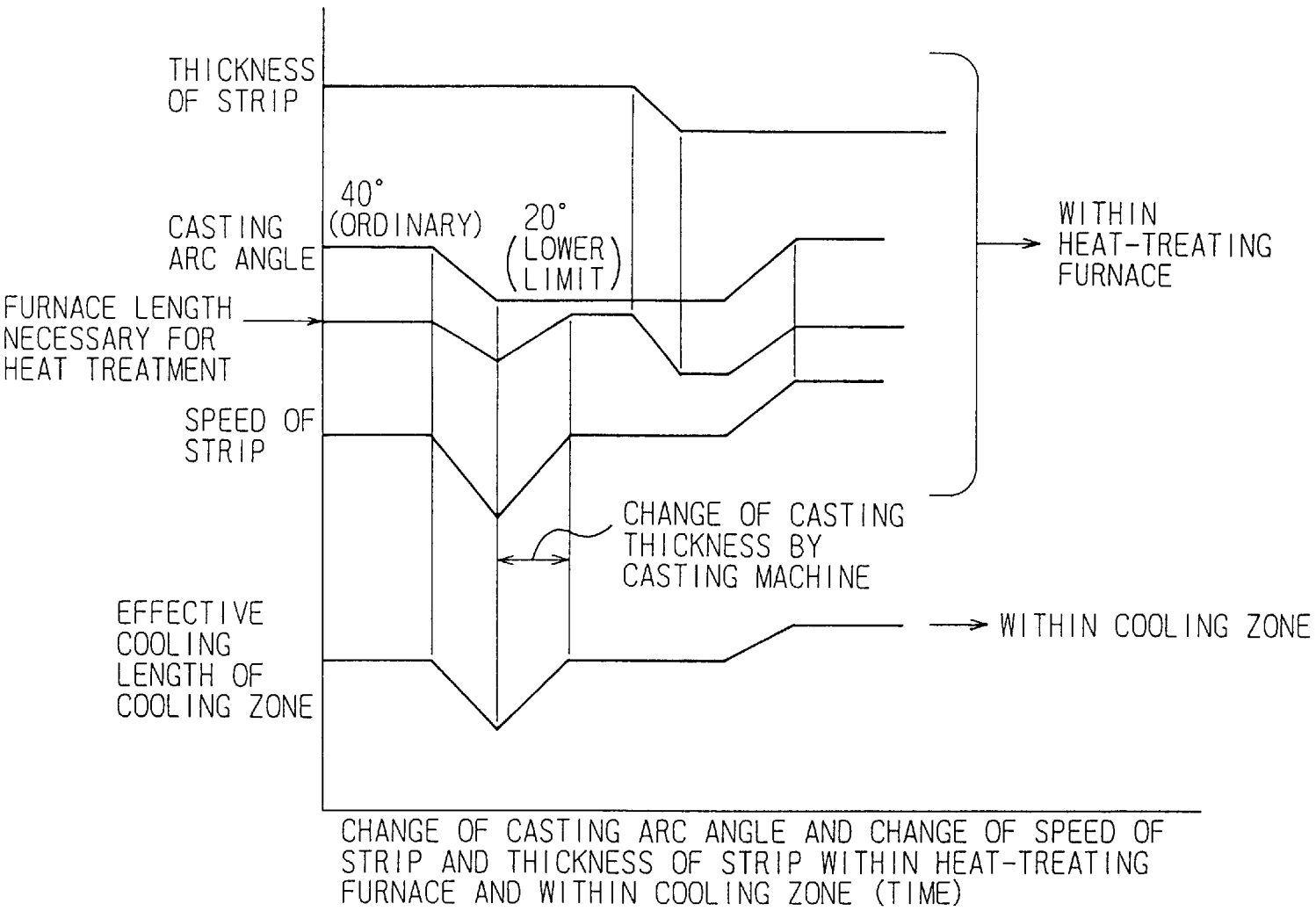
FIG. 4 is a diagram showing the relationship between the casting arc angle, the speed of strip, the effective heat treatment length of the heat-treating furnace, and the effective cooling length of a cooled strip when the thickness of a thin strip-like slab to be cast has been changed (decreased) in the apparatus for the production of a strip according to the present invention.

FIG. 4 is a diagram showing the relationship between the thickness of the thin strip-like slab, the casting arc angle, the strip speed, the heat treatment length of the heat-treating furnace, and the cooling length of the cooling zone when the thickness of the thin strip-like slab is decreased during flying in the continuous casting/hot rolling process using a twin-drum continuous casting machine as described above.

In the case of decreasing the thickness of the thin strip-like slab during flying, as described above, at the outset, the feed rate of the molten steel is temporarily lowered to decrease the level of the molten steel surface, thereby reducing the casting arc angle from the ordinary level (40°) to a level on which the molten steel is solidifiable. Thus, the casting speed is lowered. In this case, the lowering in the casting speed causes a lowering in the travel speed of the strip being passed through the heat-treating furnace, reducing the necessary heat treatment length of the heat-treating furnace. The thickness of the thin strip-like slab is then decreased by reducing the opening of the casting drum (degree of gap) to increase the casting speed, the travel speed of the strip in the heat-treating furnace is also increased, increasing the necessary length of the heat-treating furnace. When the strip in its portion where the casting thickness has been changed reaches the heat-treating furnace, the smaller the thickness of the strip to be passed, the shorter the necessary length of the heat-treating furnace. Next, the casting arc angle is returned to the original one, i.e., 40°, and casting is carried out under ordinary conditions. In this case, the degree of solidification is increased by widening the cooling zone in the cooling drums, resulting in increased thickness of the shell. For this reason, the casting speed should be increased, increasing the necessary length of the heat-treating furnace. Finally, the length of the heat-treating furnace is brought to one determined by the thickness of the thin strip-like slab and the casting speed.

As described above, according to the present invention, the heat treatment length in the heat-treating furnace and the cooling length in the cooling zone are varied depending upon the change of travel speed and thickness of the strip. The reason for this is as follows.

Specifically, the casting arc angle is reduced from 40° as the ordinary level to 20 to 30°. Since this reduces the molten steel cooling area of the cooling drums, the casting speed is decreased. Next, the gap between the drums is reduced to decrease the thickness of the casting thickness, and, in this state, the travel speed of the strip is increased. In this step, if the heat treatment length in the heat-treatment furnace remains unchanged from that before the change of the thickness of the thin strip-like slab, heat treatment conditions are varied, making it impossible to achieve predetermined heat treatment. This results in deteriorated quality of the product. On the other hand, if the cooling length in the cooling zone remains unchanged from that before the change of the thickness of the thin strip-like slab, cooling conditions are varied, making it impossible to conduct predetermined cooling. Here again, the quality of the product is deteriorated.

For the above reason, in the step of decreasing the thickness of the thin strip-like slab, at the outset, the casting arc angle is lowered to shorten the heat treatment length in the heat-treating furnace and the cooling length in the cooling zone. Thereafter, the thickness of the thin strip-like slab is reduced with the casting arc angle being lowered, and, at the same time, the casting speed is increased. Further, the heat treatment length in the heat-treating furnace and the cooling length in the cooling zone are returned to those before the change of the thickness of the thin strip-like slab, and, before the front end of the strip in its portion having a changed thickness enters the heat-treating furnace and the cooling zone, the heat treatment length in the heat-treating furnace and the cooling length in the cooling zone are changed to respective predetermined lengths. Thus, the refinement of the recrystallized grains can be ensured in the course of reducing the thickness of the thin strip-like slab during flying.

On the other hand, in increasing the thickness of the thin strip-like slab during flying in a twin-drum continuous casting machine, the height of the molten steel surface in a well defined by the drums and side weirs remains unchanged, that is, the casting arc angle is maintained on the ordinary level, and, while shortening the heat treatment length in the heat-treating furnace and the cooling length in the cooling zone, the opening between the drums is increased to decrease the casting speed, thus continuously casting a thin strip-like slab having an increased thickness. The lowering in casting speed results in a lowered travel speed of the strip being passed through within the heat-treating furnace, decreasing the necessary length of the heat-treating furnace. After a given period of time taken for the thin strip-like slab in its portion having an increased thickness to reach the heat-treating furnace has been passed, the necessary length of the heat-treating furnace increases with increasing the thickness of the thin strip-like slab. Finally, the necessary length of the heat-treating furnace is increased to a predetermined length determined by the thickness of the thin strip-like slab and the casting speed. On the other hand, immediately before the thin strip-like slab in its portion having a newly set thickness reaches the hot rolling machine, the reduction ratio in the hot-rolling machine is regulated to not less than 10%, preferably 30 to 50%, and the thin strip-like slab is hot-rolled with that reduction ratio. The hot-rolled strip is heat-treated at a strip temperature of 900 to 1200° C. for 5 sec or longer in the heat-treating furnace, cooled to 500 to 550° C. in the cooling zone, and then coiled.

In the above embodiment, the thickness of the thin strip-like slab may be changed by 0.1 to 1.0 mm. In this case, the heat treatment length and the cooling length are preferably changed by 3 to 45%.

A reduction ratio of less than 10% is unsatisfactory from the viewpoints of surface luster and roping of the product. For this reason, the reduction ratio is limited to not less than 10%.

When the cooling rate in the cooling zone is not more than 20° C./sec, Cr carbide is formed in grain boundaries of the stainless steel strip, resulting in deteriorated corrosion resistance. For this reason, the cooling rate is limited to not less than 20° C./sec.

When the coiling temperature is 500° C. or below, fine surface cracks are created in the case of a chromium stainless steel strip. On the other hand, when the coiling temperature is high, i.e., 550° C. or above, Cr carbide is formed in the grain boundaries of a stainless steel strip, resulting in deteriorated corrosion resistance. For this reason, preferably, the strip is coiled in the temperature range of from 500 to 550° C.

Since the effective cooling length of the cooling zone varies in connection with the travel speed of the strip, the effective cooling length is varied in association with the change of thickness of the strip according to the change of the travel speed of the strip and the change of travel speed of the strip, which has reached the heat-treating furnace, accompanying the change of the casting arc angle in the casting machine.

Figure 5:
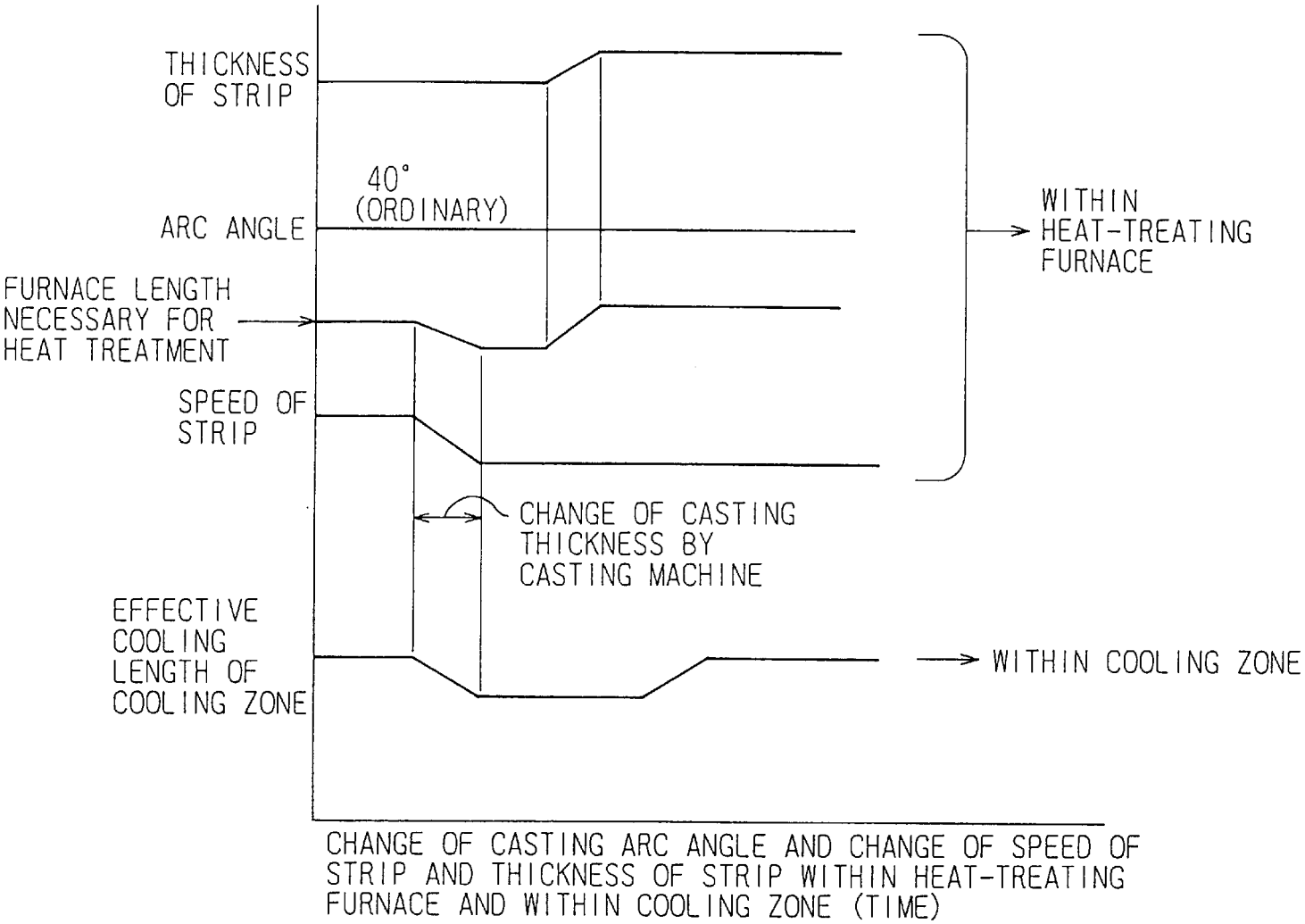
FIG. 5 is a diagram showing the relationship between the casting arc angle, the speed of strip, the effective heat treatment length of the heat-treating furnace, and the effective cooling length of a cooled strip when the thickness of a thin strip-like slab to be cast has been changed (increased) in the apparatus for the production of a thin strip-like slab according to the present invention.

FIG. 5 is a diagram showing the relationship between the thickness of the thin strip-like slab, the casting arc angle, the travel speed of strip, the necessary heat treatment length of the heat-treating furnace, and the necessary length of the cooling zone when the thickness of a thin strip-like slab to be cast has been changed to a larger one during flying in a continuous casting/hot rolling process using the above-described twin-drum continuous casting machine.

When the thickness of the thin strip-like slab is increased, the casting speed is lowered. This decreases the travel speed of the strip within the heat-treating furnace, causing the strip within the heat-treating furnace to be excessively heat-treated. In this case, however, the heat treatment time becomes about several tens of seconds longer than the predetermined heat treatment time, and, in the case of a Cr-Ni-base stainless steel, an experiment has revealed that, when the additional heat treatment time is 5 min or shorter, there is no fear of the growth of recrystallized grains to be affected.

Therefore, in the course of increasing the thickness of the thin strip-like slab, the reduction ratio is kept constant at a predetermined value of not less than 30%, and tracking is performed according to a variation in thickness of the thin strip-like slab measured with a thickness meter provided on the rolling machine inlet side to control the roll gap of the rolling machine in such a manner that the reduction ratio is brought to a predetermined value (for example, 30%).

On the other hand, in the cooling zone, since the travel speed of the strip becomes decreased, the strip is excessively cooled to 500° C. or below. In the case of the chromium stainless steel strip as described above, such supercooling creates fine cracks on the surface of the strip, and, hence, the cooling length should be decreased to a predetermined length. For this, before the front end of the strip having an increased thickness enters the heat-treating furnace and the cooling zone, the treatment furnace length in the heat-treating furnace and the cooling length in the cooling zone are changed to respective proper lengths. Thus, also in the course of increasing the thickness of the thin strip-like slab during flying, the refinement of the recrystallized grains of the product can be ensured.

The present invention is applied mainly to continuous casting of a thin strip-like slab having a thickness of 1 to 10 mm at a casting rate of 15 to 180 m/min by means of a twin-drum continuous casting machine. When the present invention is applied in this casting rate region, the heat-treating furnace should have a capability of heating the strip at a temperature rise rate of not less than 5° C./sec.

Therefore, the heat-treating furnace used in the present invention should satisfy the above requirement.

In general, for the heat-treating furnace, it can be said from the actual results and experience that, at the present time, the upper limit of the furnace temperature is 1250° C. from the viewpoint of ensuring the heat resistance. In this connection, since the temperature of the strip introduced into the heat-treating furnace is 900° C. or above, the coefficient of heat transfer cannot be enhanced in the case of a heat-treating furnace of radiant heat transfer type. Therefore, regarding the temperature elevation and holding of the strip, the requirement for the response to a change in travel speed of the strip derived from the change of thickness of the thin strip-like slab cannot be satisfied, making it difficult to ensure the capability of heating the strip at a temperature rise rate of 5 to 20° C./sec.

On the other hand, heat-treating furnaces of combustion system are classified into induction heating systems and a direct fire burner systems. In both types of systems, the capability of heating the strip at a rate of 5 to 20° C./sec can be ensured with the direct burner system being optimal from the viewpoint of equipment cost. When the heat-treating furnace of direct fire burner system is used, spray distribution of a high-temperature portion in the flame of a burner on the strip being carried within the furnace should be stabilized to evenly heat the strip and, at the same time, the strip should be passed in a catenary state through the furnace while preventing the creation of a build-up flaw on the strip by the carrier roll provided within the furnace.

In this respect, according to the present invention, the heat-treating furnace used in the present invention is constructed so that direct fire burners are disposed so as to sandwich therebetween the strip being carried, a burner flame can be ejected directly to both sides of the strip, and the capability of heating the strip at a temperature rise rate of 5 to 20° C./sec can be easily ensured.

Regarding the arrangement of the direct fire burners, an effective method is such that, in order to render the spray distribution of the high-temperature portion of the burner flame on the strip uniform, the direct fire burners are disposed in a zigzag form and, at the same time, inclined at 5 to 10° to the travel direction of the strip so that the variation of the position of the strip can be absorbed.

Further, the heat-treating furnace is constructed so that part or all of the carrier rolls within the furnace are arranged so as to be freely moved (liftable) relative to the strip carried by the carrier rolls within the furnace, and, after carrying of a dummy sheet, some of the carrier rolls within the furnace are removed to a place where they do not interfere with the strip, thereby reducing the opportunity to cause build up. A distance of removed of 250 mm suffices for carrier rolls provided, within the furnace, at intervals of 4 m, and a distance of removed of about 600 mm suffices for carrier rolls provided, within the furnace, at intervals of 10 m.

In general, on the surface of the rolls, for carrying a strip, provided within the furnace, slip occurs between the strip and the rolls, and, when the surface of the roll is made of a metal, the pseudo-deposition of the metallic structure occurs at a high temperature, creating the build-up (deposition) of the metal on the roll side. This is causative of the creation of a flaw on the surface of a strip when a next strip is passed on the surface of the roll with the metal built up thereon. For this reason, it is common practice to form a sprayed ceramic coating on the surface of the carrier rolls within the furnace, thereby preventing the pseudo-deposition to prevent the build-up.

Since, however, the interior of the heat-treating furnace used in the present invention is exposed to a very high temperature of 1200° C. or above in order to raise the temperature of a strip having a high temperature in a short time, the conventional sprayed ceramic coating is likely to be separated and cannot withstand use under such high temperature conditions for a long period of time.

For this reason, in the present invention, part or all of the carrier rolls provided within the furnace are equipped with a gas circulation cooler for spraying a cooling gas on the circumferential surface of the rolls to cool the carrier rolls provided within the furnace.

The gas used herein is one which does not deteriorating the quality of the strip and the operation of the heat-treating furnace. For example, one useful method comprises cooling a combustion waste gas, having a low oxygen concentration, from a heat-treating furnace through a cooler to 300° C. or below and circulating and spraying the cooled gas onto the surface of the carrier rolls provided within the furnace.

Among the carrier rolls provided within the furnace, at least the rolls used in threading of a dummy bar should be designed so as to prevent meander of the dummy bar, thereby permitting a strip to be stably passed through the furnace. For this purpose, the formation of a portion tapered inclined at 5° to 30° to the center on both sides in the strip carrier region of the carrier rolls provided within the furnace is effective. This enables the strip to be carried without meander within the furnace.

When the carrier roll within the furnace is lifted, the provision of a movable cover in the furnace wall portion is useful for preventing the ejection of a gas from within the furnace. Further, the drive for the carrier rolls provided within the furnace should be disposed outside the furnace so as not to be exposed to a high-temperature atmosphere within the furnace.

Other embodiments of the present invention will be described with reference to FIGS. 7 to 13.

Figure 7:
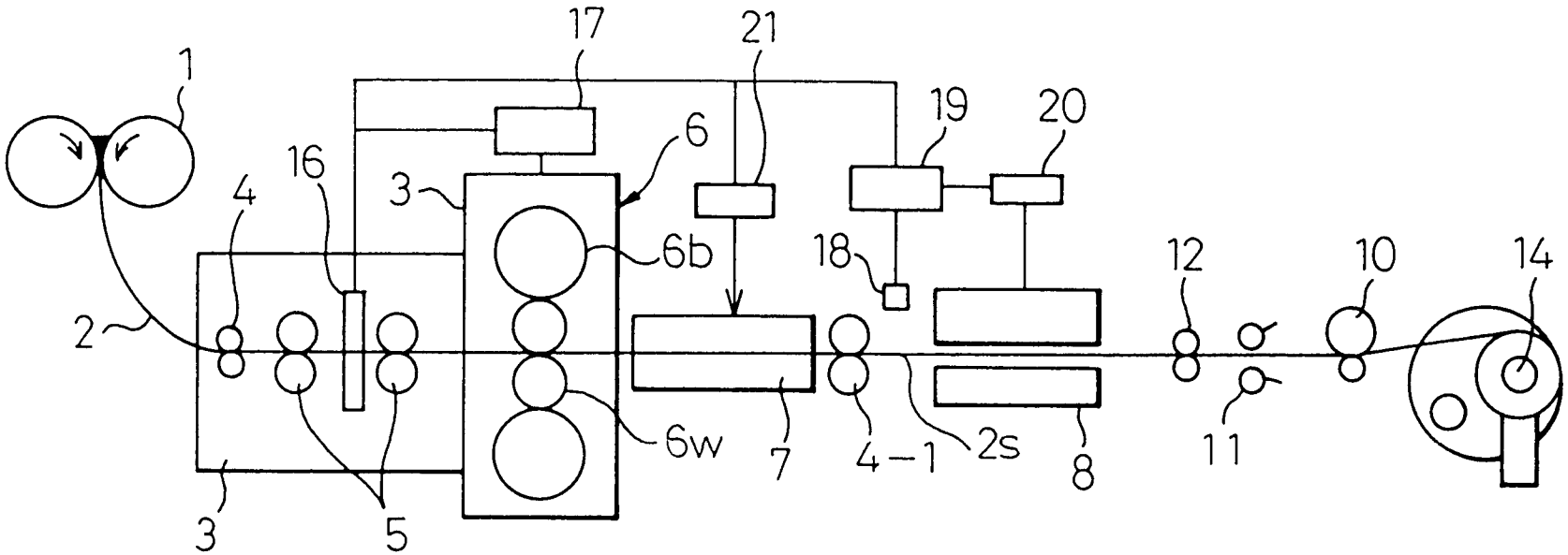
FIG. 7 is a schematic side view showing another embodiment of the apparatus for the production of a strip according to the present invention.

FIG. 7 is an embodiment of the layout of continuous casting/hot rolling equipment for a stainless steel strip to which the present invention has been applied. In FIG. 7, numeral 1 designates a twin-drum continuous casting machine, numeral 2 a continuously cast thin strip-like slab, and numeral 3 an atmosphere cover for preventing the oxidation and temperature fall of a thin strip-like slab. A pinch roll 4 downstream of a drum, a pair of pinch rolls 5-1, 5-1 before a hoot rolling machine, and a hot rolling machine 6 equipped with a work roll 6W and a backup roll 6*b* are provided within the cover.

As described above, the pair of pinch rolls before the rolling machine constitute one of the features of the present invention.

The edge in the thin strip-like slab 2 cast in the twin-drum continuous casting machine 1 is unstable in its shape and is cracked. The cracks are opened under wave pressed conditions and should be cut out under pressure in the rolling machine.

A large pushing force can impart necessary tension. In this case, the thin strip-like slab is pressed by means of the pinch roll, causing plastic deformation of the thin strip-like slab. In general, the pinch roll has no capability of controlling the shape and, hence, creates waving, center buckling or the like. This disturbs the original shape on the inlet side of the rear mill, and the rolling of the thin strip-like slab having such a shape creates two-piece biting or disturbance of tension, beginning with the portion where the shape is broken, often causing breaking of the thin strip-like slab in the course of rolling.

For this reason, preferably, two sets of pinch rolls are juxtaposed based on the limitation of the pushing force which does not create the plastic deformation. Specifically, when the tension is increased from the tension necessary for the casting, 0.1 to 0.5 kg/mm$^2$, to the tension necessary for rolling, 0.5 to 1.5 kg/mm$^2$, the tension difference is divided into two parts to reduce the load per set of pinch rolls.

The provision of the above pinch rolls ensures stable rolling without breaking or meander of the thin strip-like slab.

A heat-treating furnace 7 is disposed on the outlet side of the rolling machine, and a cooling zone 8 through a pinch roll 4-1, a cutter 11 through a pinch roll 12 provided before the cutter, and a coiler 14 of a Carozel type through a pinch roll 10 before the coiler are successively provided on the outlet side of the heat-treating furnace.

Well-known controllers (not shown) for controlling the rotating speed (casting speed) of the drum, the level of molten steel surface, pushing of side weir, the opening between the drums and the like are connected with the twin-drum continuous casting machine 1. Further, a thin strip-like slab thickness meter 16 is disposed between a pair of pinch rolls 5-1, 5-1 before the rolling machine, and information on the thickness is sent from the thickness meter to a rolling controller 17. The rolling control of the hot rolling machine 6 is performed through the rolling controller.

The information on the thickness from the thickness meter 16, together with information on the temperature from a strip thermometer 18 disposed on the inlet side of the cooling zone 8, is sent to a cooling zone controller 19 which controls a cooling zone ejecting device 20 to control cooling conditions in the cooling zone 8.

As described above, the heat-treating furnace 7 used herein should control heat treatment conditions in response to a variation in line speed derived from the change of thickness of the thin strip-like slab, and the response should be such that the temperature of the strip is raised at a rate of 5 to 20° C./sec.

Further, the creation of build-up by the carrier rolls within the furnace should be prevented to ensure the quality of the strip. For this purpose, in the present embodiment, a heat-treating furnace having a structure as shown in FIGS. 8, 11 (A), 11 (B), and 12 is used.

Figure 8:
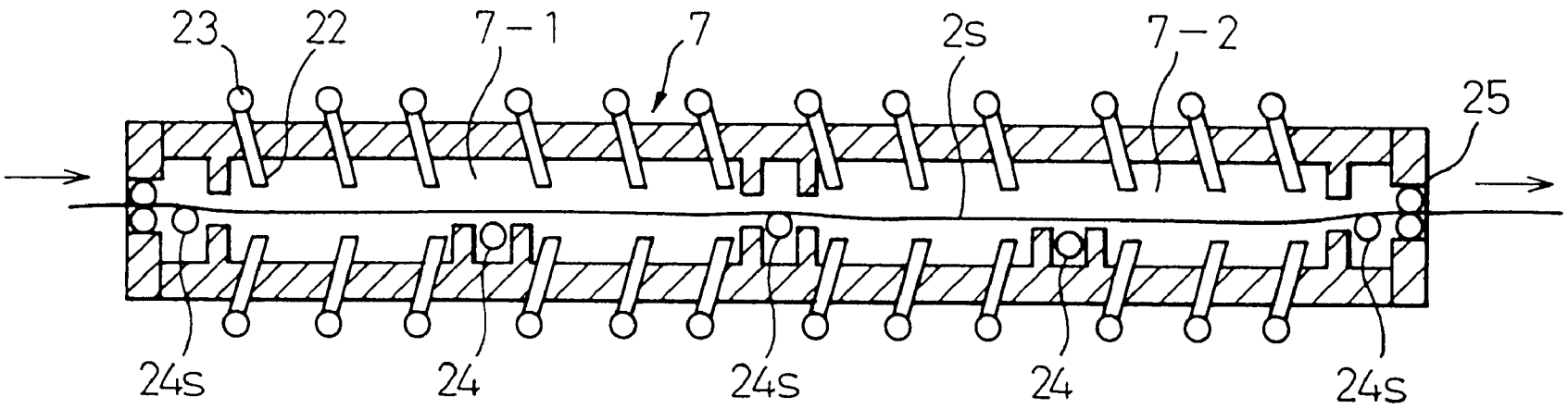
FIG. 8 is a longitudinal sectional side view of a heat-treating furnace in the apparatus for the production of a strip according to the present invention.
Figure 11B:
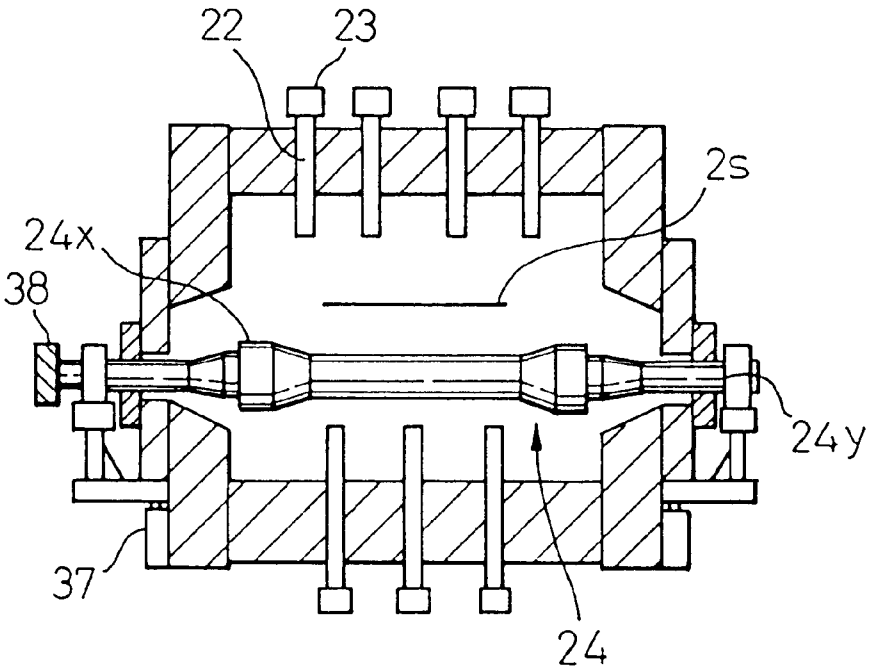
FIG. 11 (A) is a cross-sectional view, of a heat-treating furnace in the widthwise direction according to one embodiment of the present invention, illustrating the conveyance of a dummy sheet, and FIG. 11 (B) is a cross-sectional view illustrating the conveyance of a strip.
Figure 11A:
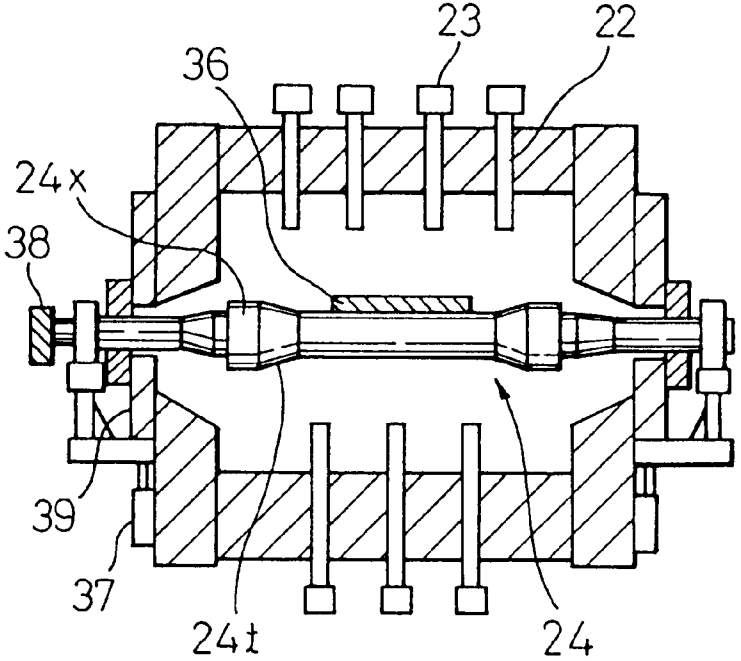

As shown in FIGS. 8, 11 (A), and 11 (B), the wall of the heat-treating furnace is provided with a number of direct fire burners 22 of a direct heating system which spray a flame onto both sides of a strip 2*s* during carrying within the furnace to directly heat the strip 2*s*. A fuel gas and a supporting gas are fed through a header pipe 23 into the burners. The system for feeding the fuel gas and the supporting gas is divided into a plurality of parts (7-1, 7-2) in the longitudinal direction of the furnace, and each feed system is opened or closed to change the heat treatment length, thereby varying the heat treatment conditions. The heat treatment conditions may be varied also by regulating the amount of the fuel gas and the supporting gas fed into each feeding system.

Figure 9:
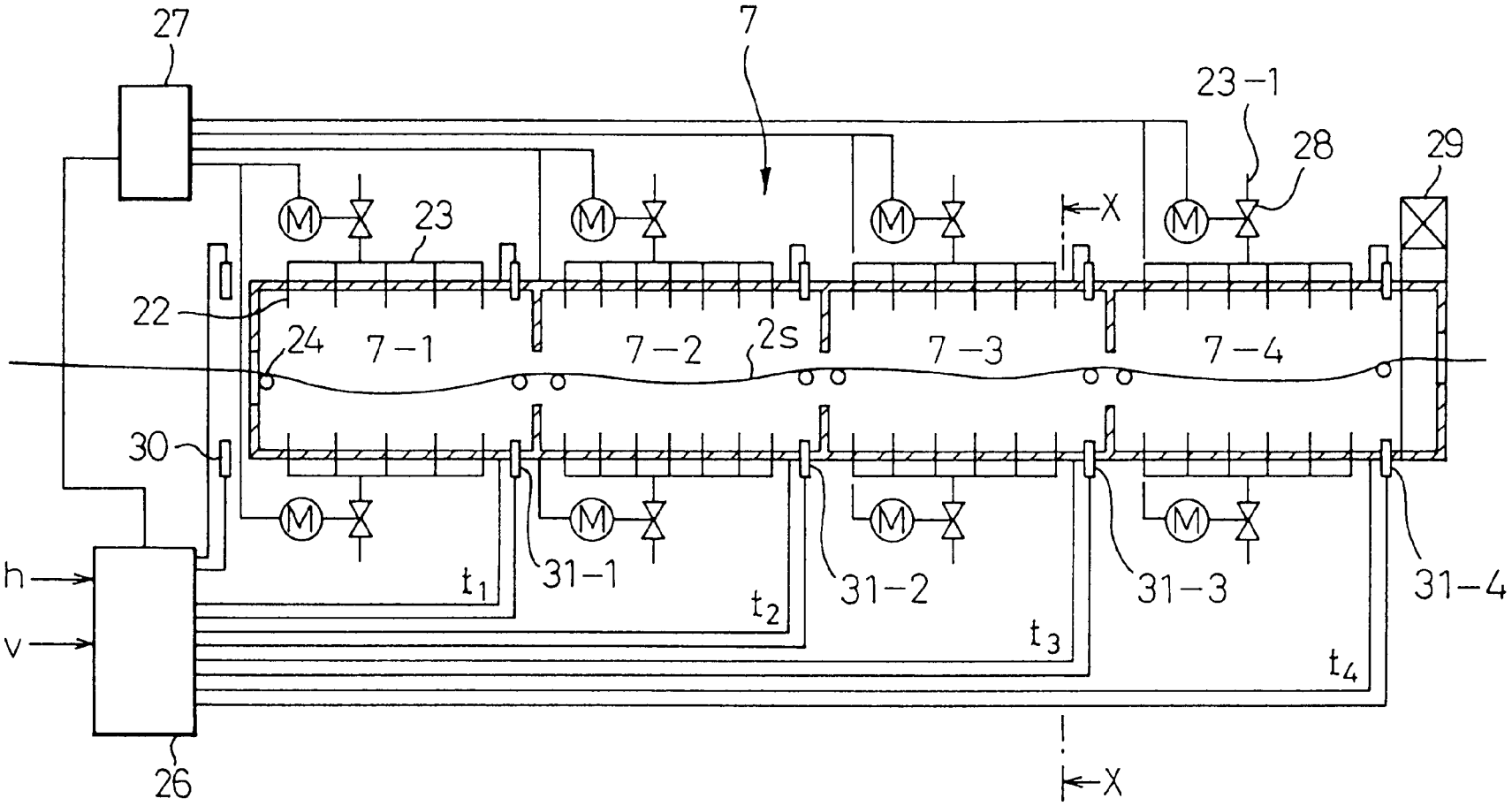
FIG. 9 is a longitudinal sectional side view of a heat-treating furnace according to another embodiment of the present invention.

One embodiment of the controller in the above heat-treating furnace 7 will be described. As shown in FIG. 9, the heat-treating furnace 7 is divided into four parts in the longitudinal direction thereof, and, for each zone, a plurality of direct fire burners 22 are independently connected to a header pipe 23. A combustion gas feed pipe 23-1 is connected to the header pipe 23. The combustion gas feed pipe 23-1 is provided with a combustion gas flow rate control valve 28 which is connected to a burner combustion controller 27. The control valve is actuated on receipt of instruction of the controller. An exhaust gas duct 29 is provided on the outlet side of the heat-treating furnace.

A combustion control/computing unit 26 is connected to the burner combustion controller 27, and the measured temperature tc in a temperature sensor 30 on the inlet side of the heat-treating furnace and the measured temperatures $t_1$ to $t_4$ in strip temperature sensors 31-1 to 31-4 on the outlet side of each zone are input into the computing unit 26. Although in the embodiment shown in the drawing, the measured temperatures $t_1$ to $t_4$ are input, the strip temperature sensor may be provided only on the outlet side of the heat-treating furnace, zone 7-4 in this embodiment. In addition, strip thickness h at the heat-treating furnace inlet and strip travel speed v at the heat-treating furnace inlet are input. The time T (sec) for heat treatment within the heat-treating furnace is determined by the equation:

$$T=f(tc\cdot h\cdot v)$$

to regulate the heat treatment time in each zone, that is, the burner combustion range.

For example, when the strip thickness is minimum, the zone 7-1 in the heat-treating furnace 7 is the combustion range of the burner. On the other hand, when the strip thickness is maximum, the zones 7-1 to 7-4 constitute the combustion range.

Full combustion is carried out in the zone 7-1 with the strip temperature being $t_1$ and the zone 7-2 with the strip temperature being $t_2$. In the zone 7-3 with the strip temperature being $t_3$, the combustion is regulated so as to avoid overheating of the strip, while in the zone 7-4 with the strip temperature being $t_4$, the combustion is regulated or quenched and the strip temperature is held by taking advantage of the heat of the exhaust gas.

Thus, in the present invention, feedback control is performed by means of the combustion control/computing unit.

Figure 10:
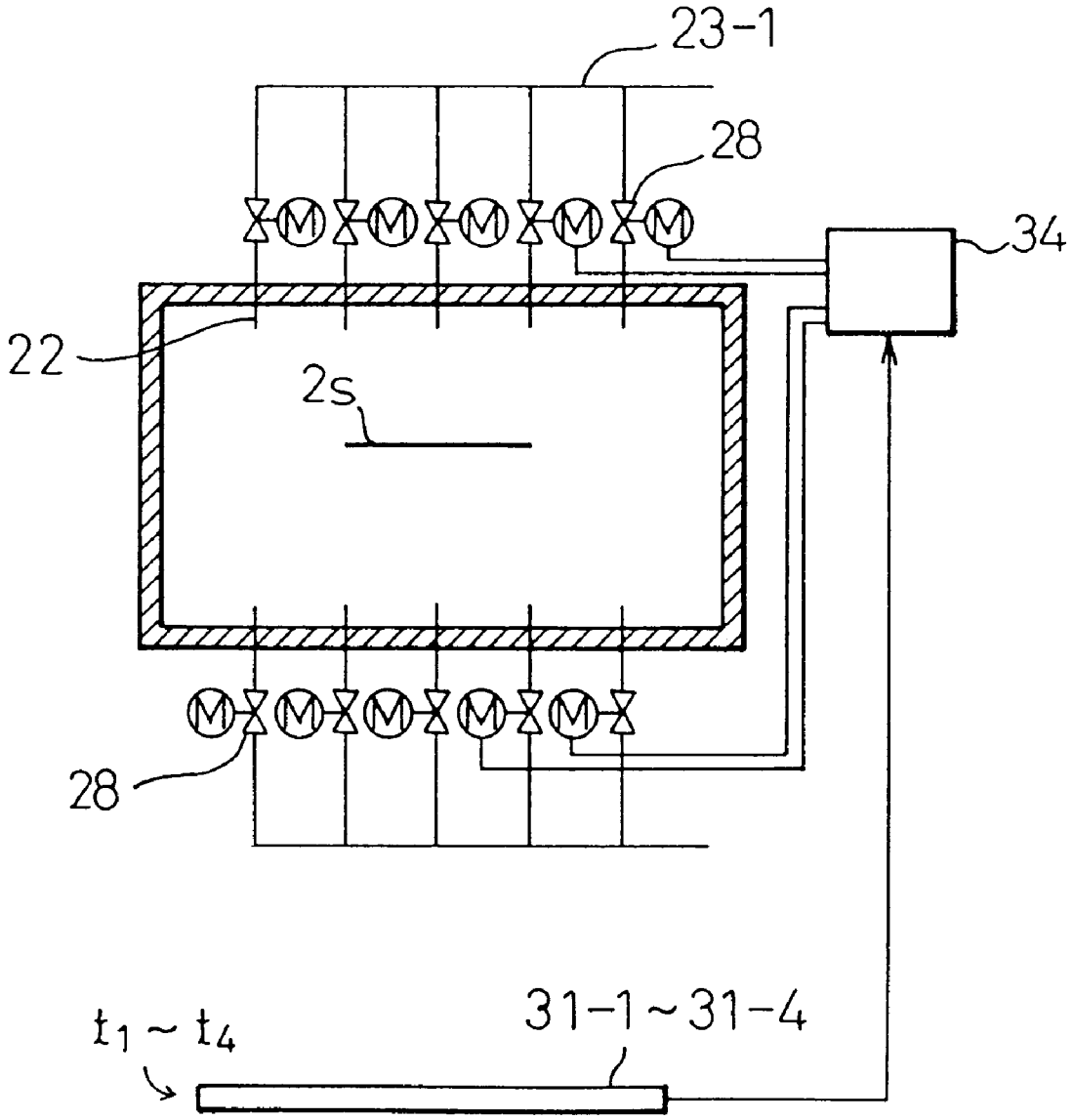
FIG. 10 is a cross-sectional view taken on line X—X of FIG. 9.

As shown in FIG. 10 which is a cross-sectional view taken on line X—X of FIG. 9, a plurality of header pipes 23 are juxtaposed in the widthwise direction of the heat-treating furnace, and a controller 34 for the temperature distribution in the widthwise direction of the strip is further connected to the combustion gas flow rate control valve 28, and signals for the temperature measured with a temperature sensor 31 provided in the widthwise direction of the strip downstream of the zone are input into the controller 34. The controller serves to feedback the state of temperature distribution in the widthwise direction of the strip into the combustion gas flow rate control valve 28 to spray the combustion gas onto a desired strip edge portion, thereby preventing a temperature fall at the strip edge portion (a temperature of at least −20° C. lower than the target set temperature creates roping) and overheating (energy saving effect).

In the embodiment shown in FIG. 8, five carrier rolls 24 are provided within the heat-treating furnace 7, and, as shown in FIGS. 11 (A) and 11 (B), the carrier rolls 24 are provided so as to be liftable by means of a lifting device (a hydraulic cylinder) 37. When a dummy sheet 36 is carried, it is carried while supporting it by all the carrier rolls 24*s*, 24*x* within the furnace. On the other hand, in the step of carrying a strip, from the viewpoint of preventing build-up, the carrier roll 24*x* provided within the furnace is lowered and withdrawn so as not to come into contact with the strip 2*s*, and the strip 2*s* is carried using a minimized number of carrier rolls, for example, carrier roll 24*s* alone.

In the carrier rolls provided within the furnace, a tapered portion 24*t* inclined at 5° to 30° to the center on both sides in the strip carrier region is formed to prevent meander of the strip during carrying. A drive 38 for the carrier rolls is disposed outside the furnace. A movable cover 39, which is lifted together with a shaft 24*y* by means of a lifting device 37 and slid on the surface of the furnace wall, is disposed on the surface wall portion along which the shaft 24*y* of the carrier roll is lifted.

A seal roll 25 for a heat-treating furnace is disposed on the inlet and outlet of the heat-treating furnace 7.

Figure 12:
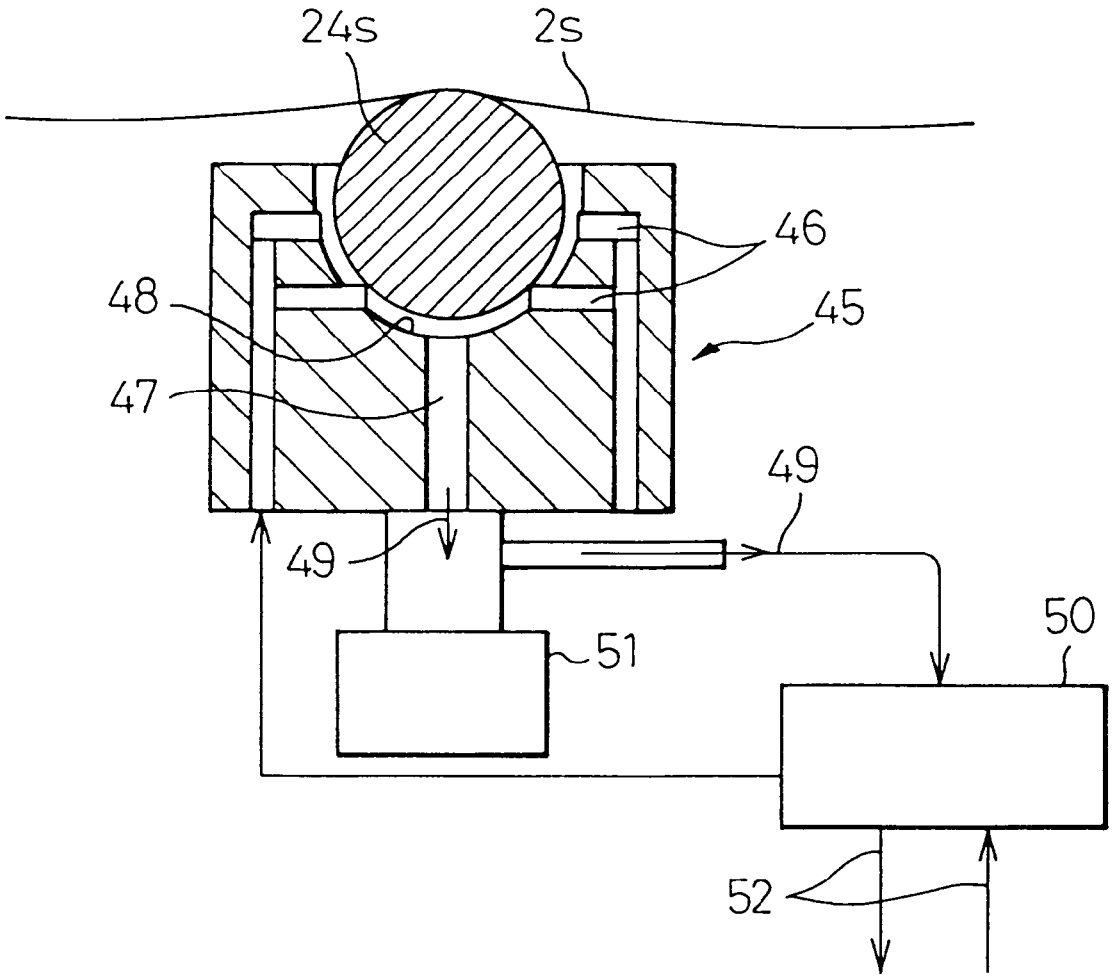
FIG. 12 is a schematic view partly in section of a carrier roll within a heat-treating furnace according to the present invention, wherein the carrier roll has a gas circulation cooling structure.

Further, since the carrier rolls 34*s*, 34*x* provided within the furnace are exposed also to a high-temperature flame of the burner, as shown in FIG. 12, a cooling pad 45, which has a curved surface 48 along the circumferential surface of the carrier roll 34*x* provided within the furnace and equipped with a cooling gas ejection port 46 and an exhaust port 47, is provided in proximity to the circumferential surface of the carrier roll 34*x*.

An exhaust gas 49 containing a scale is discharged through the exhaust port 47, and, hence, there is a fear of the line being damaged by the scale. In order to avoid this unfavorable phenomenon, the scale contained in the exhaust gas 49 is separated in a scale separation chamber 51, and the exhaust gas 49 with the scale removed therefrom is cooled through a cooler 50 (through which cooling water 52 is passed) and circulated. The cooled gas is ejected through an ejection hole 46 onto the surface of the carrier roll 24*s* provided within the furnace.

Regarding the cooling gas ejected through the cooling pad 45 onto the circumferential surface of the carrier roll 24*s*, a combustion exhaust gas, having a temperature of 800 to 900° C. and a low oxygen concentration, from the heat-treating furnace 7 is used here from the viewpoints of preventing the oxidation of the strip and, at the same time, minimizing the influence on the heat treatment. In this case, the combustion gas is cooled through the cooler 50 to a temperature of 300° C. or below and circulated and ejected through the ejection hole 46.

Further, the following heat-treating furnace may be provided in order to improve the maintenance of the furnace at the time of emergency stop, such as discharge of the strip which stays within the furnace.

Figure 13B:
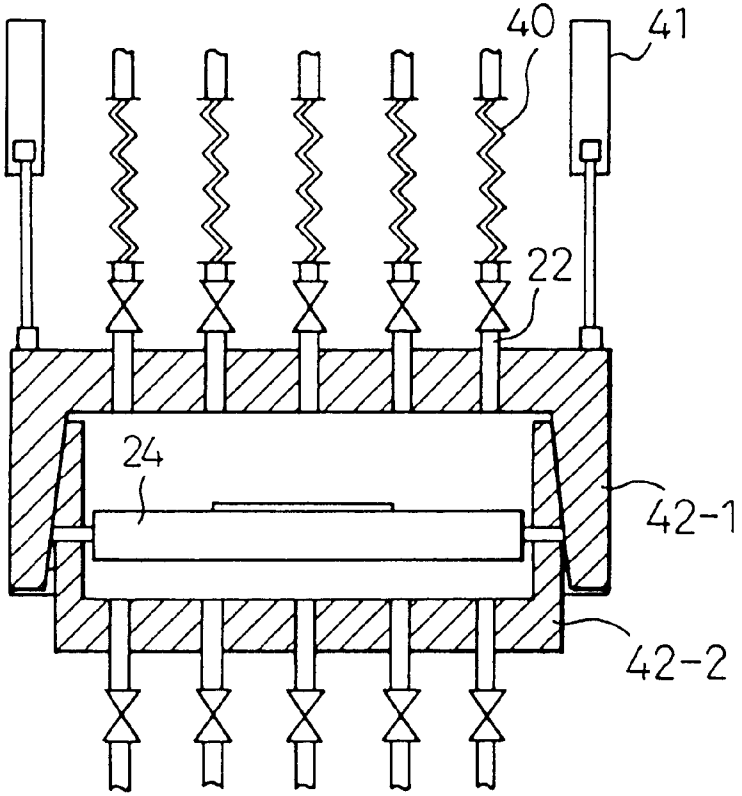
FIG. 13 (A) is a cross-sectional view of a heat-treating furnace in the widthwise direction according to another embodiment of the present invention, wherein the upper wall of the furnace is in the ascended state (released state), and FIG. 13 (B) is a cross-section view of a heat-treating furnace of the same type as shown in FIG. 13 (A), wherein the upper wall of the furnace is in the descended state (closed state).
Figure 13A:
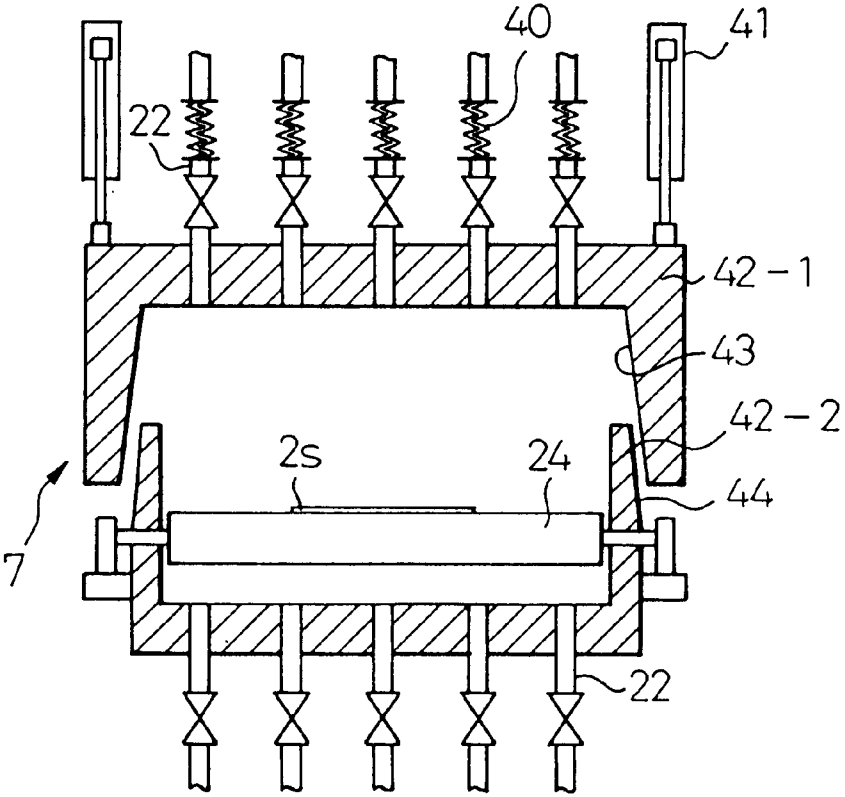

Specifically, as shown in FIGS. 13 (A) and 13 (B), the side wall of the heat-treating furnace 7 is divided in the longitudinal direction thereof into a lower wall section 42-1 provided with a carrier roll 24 and an upper wall portion 42-2, and an inner side surface 43 of the upper wall section and an outer side surface 44 of the lower wall section are tapered. A lifting actuator 41 is provided on the upper portion of the upper wall section 42-1, and direct fire burners are connected to respective flexible hoses 40. At the time of work within the furnace, as shown in FIG. 13 (A), the upper wall section is lifted through the actuator 41, and, as shown in FIG. 13 (B), the upper wall section descends during the heat treatment so that the tapered surfaces of both the walls come into contact with each other, thus bringing the heat-treating furnace to a sealed state.

The present invention can be practiced through the following steps using the following continuous casting/hot rolling equipment. In the present invention, when the thickness of the thin strip-like slab is changed during continuous casting of a stainless steel, the level of the surface of the molten stainless steel cast by means of a twin-drum continuous casting machine 1 is lowered to 20° to 30° in terms of the casting arc angle to lower the casting speed, and, thereafter, the opening between the casting drums is reduced, thus changing the thickness of the thin strip-like slab during flying to a smaller one. This operation can eliminate the influence of the thickness of the thin strip-like slab on the refinement of recrystallized grains even when the strip is produced without varying the reduction ratio in a hot rolling machine provided downstream of the casting drums and without increasing the effective heating range in the heat-treating furnace and by cooling the strip in a cooling zone to 500 to 550° C.

When a strip in its portion having a reduced thickness has reached the heat-treating furnace, predetermined heat input in the heat-treating furnace is reduced enabling the effective heat treatment length in the heat-treating furnace to be shortened. In this case, when direct fire burners are used, the heat input can be efficiently reduced because they can directly heat the strip.

Regarding the cooling zone, tracking of the thickness of the thin strip-like slab is performed using a thickness meter positioned upstream of the hot rolling machine, the necessary cooling zone length is determined by computation according to the thickness of the strip introduced into the cooling zone and the temperature and travel speed of the strip at the cooling zone inlet, and the strip is cooled to a coiling temperature of 500 to 550° C.

On the other hand, when the thickness of the thin strip-like slab is changed to a larger one during continuous casting of a stainless steel, the opening between the casting drums is increased to decrease the casting speed and, at the same time, the thickness is changed to a larger one during flying. In the hot rolling machine 6 located downstream of the casting drums, the portion having a changed thickness is always grasped by means of a thickness meter 16 provided upstream of the hot rolling machine, and, when the portion having a changed thickness has just reached the hot rolling machine, the roll gap of the rolling machine is varied to conduct rolling with the same reduction ratio (30 to 50%). Before the portion having an increased thickness thus rolled reaches the heat-treating furnace 7, the furnace temperature raising range (heat treatment length) is increased by means of the heat treatment controller 21 to a predetermined effective heating length. This eliminates the influence of the strip thickness on the refinement of recrystallized grains.

Regarding the cooling zone 8, as with the case of reducing the strip thickness, tracking of the thickness of the thin strip-like slab is performed using a thickness meter 16 positioned upstream of the hot rolling machine 6, the necessary cooling zone length is determined by computation using a cooling zone controller 19 according to the thickness of the strip 2*s* introduced into the cooling zone 8 and the temperature of the strip, at the cooling zone inlet, measured with a thermometer 18 for a strip and the travel speed of the strip at the cooling zone inlet, and the strip is cooled to a coiling temperature of 500 to 550° C.

The hot rolling machine 6 is equipped with a high-speed bender and a high-speed AGC (not shown), and a thickness meter 16 is provided on the inlet side of the hot rolling machine. The shape of the thin strip-like slab 2 is measured by the thickness meter 16, the high-speed bender (control of shape) and the high-speed AGC (strip thickness controller) of the hot rolling machine 6 are subjected to feed forward control by means of a rolling controller 17 to conduct the determination, at the hot rolling machine 6 inlet, of the strip in its portion having a thickness changed by the casting drums, and tracking of the thickness is performed to roll the thin strip-like slab by means of the hot rolling machine without breaking the shape at a high speed, thereby improving the yield of the strip 2*s* in the transition period for change of the strip thickness.

The heat-treating furnace 7 is a heat-treating furnace of direct fire burner system and can directly vary the temperature of the strip at a rate of 5 to 20° C./sec so that the heat input into the strip can be controlled by means of a heat treatment controller 21 according to a variation (±30%) in line speed relative to the same thickness of the thin strip-like slab.

Figure 15:
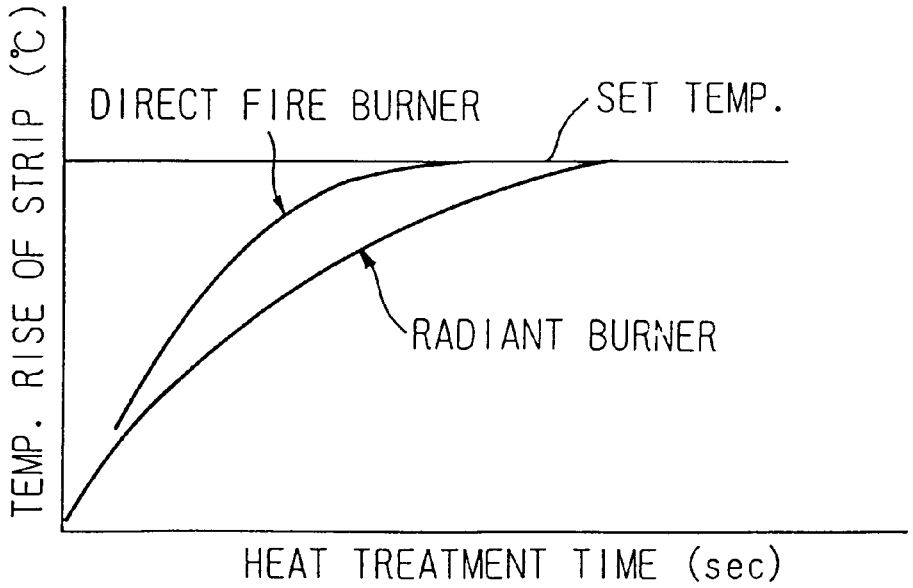
FIG. 15 is a diagram showing the relationship between the heat treatment time and the temperature rise of the strip for various burners.

The response of a direct fire burner, in comparison with that of a radiant burner, is shown in FIG. 15. Specifically, when the relationship between the set strip temperature, to which the strip should be heated, and the time taken for the temperature of the strip to be raised to the set temperature is examined, it is apparent that the use of the direct fire burner provides more rapid temperature rise of the strip than the use of the radiant burner, demonstrating that, in the case of the direct fire burner, the temperature of the strip reaches the set temperature in a shorter time than the case where the radiant burner is used.

Further, a variation in casting speed and a variation in thickness of thin strip-like slab on the inlet side of the hot rolling machine are measured with a thickness meter 16, and tracking of a variation point, with respect to the thickness of the strip, which is effective until the heat treatment in the heat-treating furnace, is performed enabling the heat treatment to be controlled according to a change in travel speed of strip 2*s* caused by the change of thickness of the thin strip-like slab during flying. This in turn enables recrystallized grains to be refined.

Figure 17:
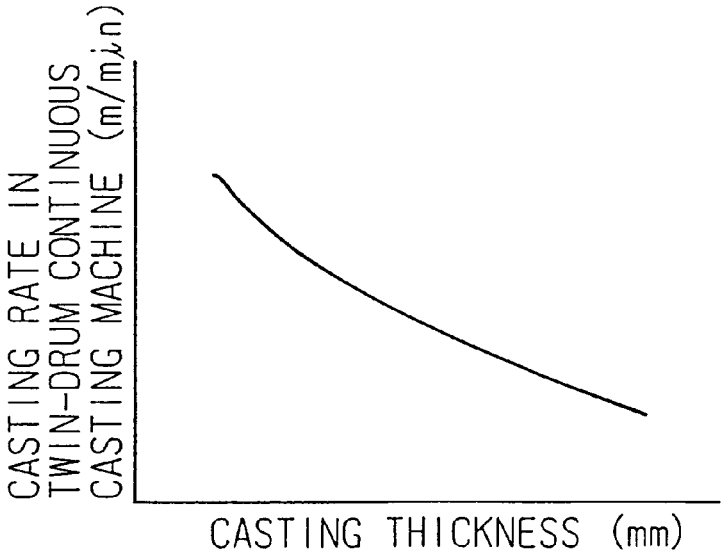
FIG. 17 is a diagram showing the relationship between the casting speed and the thickness of the resultant cast thin strip-like slab for a twin-drum continuous casting machine.

The relationship between the casting speed of the twin-drum continuous casting machine and the thickness of the thin cast strip-like slab is as shown in FIG. 17.

The thickness of the thin strip-like slab is measured with a thickness meter 16, and the casting speed is determined based on this measured value.

Figure 16:
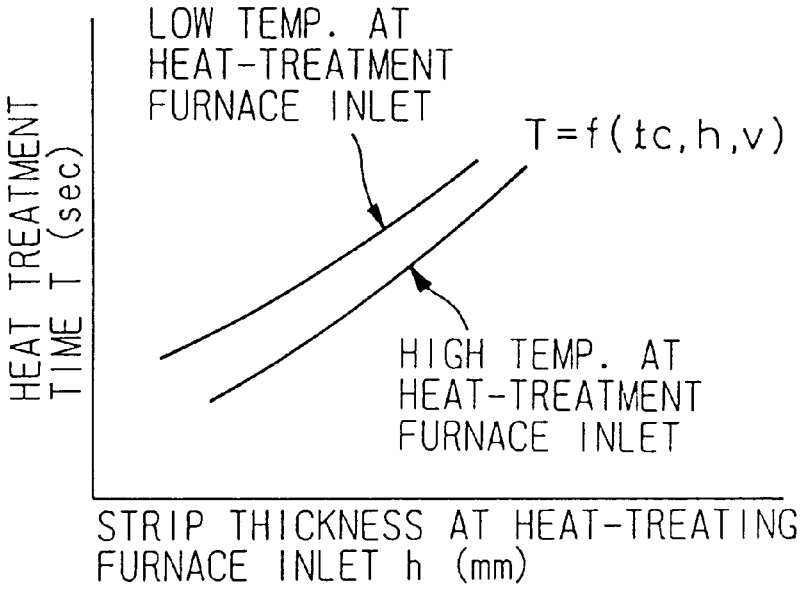
FIG. 16 is a diagram showing the relationship between the thickness of the strip at the heat-treating furnace inlet and the heat treatment time in the case of a high temperature at the heat-treating furnace inlet and a low temperature at the heat-treating furnace inlet.

Based on these parameters, the thickness h of the strip at the heat-treating furnace inlet and the travel speed v of the strip at the heat-treating furnace inlet are determined, and, by measuring the temperature tc at the heat-treating furnace inlet, the heat treatment time T, that is, the heating zone length of the heat-treating furnace, according to the strip thickness at the heat-treating furnace inlet can be determined from FIG. 16.

A dummy sheet 36 is used in carrying of a strip in the initiation of the casting. When the dummy sheet is passed through the heat-treating furnace 7, the temperature rise is suppressed to ensure the strength of connection between the dummy sheet and a thin strip-like slab 2. After the strip enters the heat-treating furnace 7, full combustion is performed to rapidly heat the strip, enabling a predetermined heat pattern to be created.

In general, the heat treatment time increases with increasing the thickness of the strip 2*s*, and the increase in the heat treatment time results in reduced strip thickness. In this case, the effective treatment length in the heat-treating furnace 7 is controlled by means of a heat treatment controller 21 depending upon the thickness of the strip. Regarding the burner used herein, a burner having good response, such as a direct fire burner 22, can efficiently offer energy saving.

When the rolls 24*x* provided, for carrying a dummy sheet, within the heat treating furnace 7 are liftable, part thereof may be refuged to reduce the number of carrier rolls which come into contact with the strip 2*s* being passed through the furnace, reducing the opportunity to cause the build-up. Further, the heat-treating furnace is constructed so that the carrier roll 24*s*, provided within the furnace, for carrying the strip 2*s* is cooled by circulating an exhaust gas, having a low oxygen concentration, discharged from the heat-treating furnace through a cooler 50 and ejecting the cooled exhaust gas through a cooling pad 45 onto the carrier roll. By virtue of this construction, the occurrence of build-up on the carrier roll 24*x* provided within the furnace can be prevented without detriment to the atmosphere within the furnace.

Further, the surface temperature of the roll can be kept at 900° C. or below to inhibit the separation of a sprayed ceramic coating formed on the surface of the roll, improving the service life of the roll.

The direct fire burners 22 in the heat-treating furnace 7 are disposed so as to be inclined toward the carrying direction of the strip, and this can prevent the burners from being damaged by a flame reflected from the strip 2*s* and can improve by about 5% the convective heat transfer effect attained by flow of the flame of the burner.

Since the strip 2*s* becomes a catenary state, the direct fire burners are arranged by taking this into consideration and, even when the strip moves away from the burner, a lowering in the coefficient of heat transfer can be minimized by virtue of catenary state of the flame of the burners. Further, the arrangement of the direct fire burners 19 in a zigzag form in the carrying direction of the strip can disperse a heat spot caused by local heating by the direct fire burner and prevent uneven temperature distribution.

Figure 14:
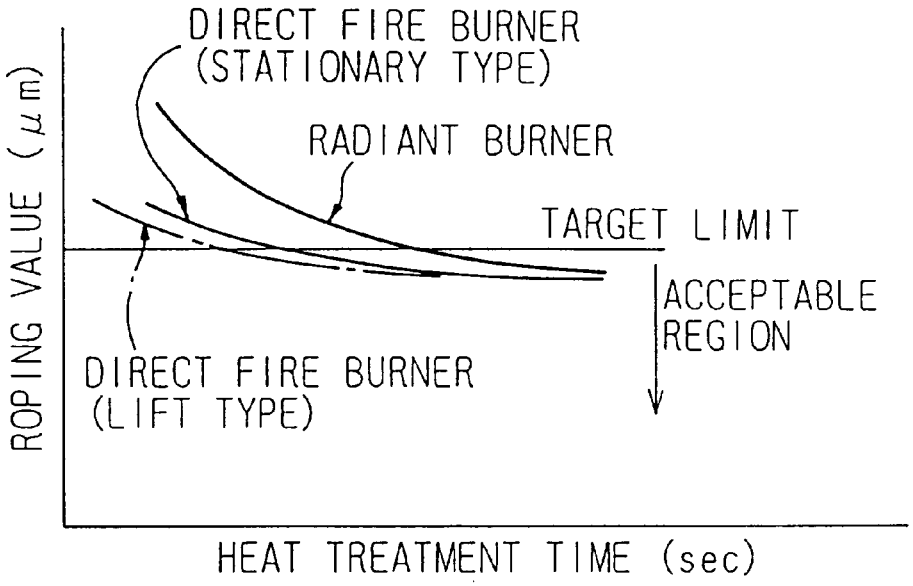
FIG. 14 is a diagram showing the relationship between the heat treatment time and the roping value for various burners.

In the above-described apparatus, the relationship between the heat treatment time and the roping value for different types of heating means in the heat-treating furnace is as shown in FIG. 14.

Specifically, it is apparent that the roping value in the case of the direct fire burner is lower than that in the case of the radiant burner.

The present invention is not limited to the above embodiment, and the continuous casting machine, the hot rolling machine, the heat-treating furnace, the cooler, the coiler, the equipment, various control structures, the specifications, number, and operating conditions of these individual elements and the like may be altered according to the casting material, casting conditions, conditions for changing the casting thickness, hot rolling conditions and the like so far as the requirements of the present invention are satisfied.

The stainless steel strip produced according to the present invention may be subjected to pickling/cold rolling, annealing/pickling, or bright annealing to prepare a product. There is no limitation, inherent in the present invention, on conditions for these treatments, and industrial operating conditions commonly used in the art may be used without posing any particular problem.

EXAMPLE 1

Cr-Ni-base stainless steels, comprising a 18%Cr-8%Ni steel as a base steel, specified in Table 1 and prepared by a melt process were cast into thin strip-like slabs having various thicknesses, between 2 mm and 10 mm, using an apparatus including a twin-drum continuous casting machine and a hot-rolling machine as shown in FIG. 3. After the casting, the temperature of the thin strip-like slabs were controlled by means of a jet burner, and the thin strip-like slabs were hot-rolled in the temperature range of from 900 to 1200° C. The reduction ratio in the hot rolling was 10 to 50%. After the completion of the hot rolling, the temperature of the hot-rolled strips was controlled by means of a jet burner, and the strips were heat-treated in the temperature range of 900 to 1200° C. for 5 sec or longer and then coiled at a temperature of 600° C. or below. For comparative materials, hot-rolling conditions, conditions for heat treatment after hot rolling, or coiling conditions were outside the scope of the present invention.

Thereafter, the materials were pickled, descaled, cold-rolled, and then subjected to conventional annealing or bright annealing.

The surface appearance of the products thus prepared was inspected. In particular, attention has been drawn to the height of roping and luster of the surface of the products. As shown in Table 1, for all the samples falling within the scope of the present invention, a fine recrystallization texture was provided by virtue of optimization of hot-rolling conditions and conditions for heat treatment after hot rolling, and a combination of the above optimization with the control of the cooling rate provided good surface quality of the product.

On the other hand, for the comparative process, the hot-rolling temperature, reduction ratio, or heat treatment after hot rolling was unsatisfactory, and, further, subsequent control of cooling was not done, resulting in remarkable roping and poor surface luster.

TABLE 1

| | No. | Type of steel | Thickness of thin strip-like slab(mm) | Hot-rolling conditions Temp. (°C.) | Hot-rolling conditions Reduction ratio (%) | Hot treatment conditions Temp. (°C.) | Hot treatment conditions Time (sec) | Cooling rate in the temp. range of 900–600 °C. | Coiling Temp. (°C.) | Sheet production step | Surface quality (μm) | Surface quality Roping Luster |
|---|---|---|---|---|---|---|---|---|---|---|---|---|
| Process using inv. | 1 | SUS304 | 3 | 1100 | 30 | 1100 | 10 | 50 | 600 | A | Good (0.07) | Good |
| | 2 | SUS304JIL | 5 | 1100 | 30 | 1100 | 10 | 50 | 600 | A | Good (0.18) | Good |
| | 3 | SUS305 | 3 | 1100 | 30 | 1100 | 10 | 50 | 600 | A | Good (0.09) | Good |
| | 4 | SUS310 | 3 | 1100 | 30 | 1100 | 10 | 50 | 600 | A | Good (0.08) | Good |
| | 5 | SUS316 | 3 | 1100 | 30 | 1100 | 10 | 50 | 600 | A | Good (0.07) | Good |
| | 6 | SUS308 | 3 | 1100 | 30 | 1100 | 10 | 50 | 600 | A | Good (0.07) | Good |
| | 7 | SUS301 | 3 | 1100 | 30 | 1100 | 10 | 50 | 600 | A | Good (0.08) | Good |
| | 8 | SUS309 | 3 | 1100 | 30 | 1100 | 10 | 50 | 600 | A | Good (0.07) | Good |
| | 9 | SUS304 | 3 | 1100 | 30 | 1100 | 10 | 50 | 600 | A | Good (0.07) | Good |
| | 10 | SUS304 | 10 | 1100 | 30 | 1100 | 10 | 50 | 600 | A | Good (0.08) | Good |
| | 11 | SUS304 | 3 | 900 | 30 | 1100 | 10 | 50 | 600 | A | Good (0.19) | Good |
| | 12 | SUS304 | 3 | 1000 | 30 | 1100 | 10 | 50 | 600 | A | Good (0.10) | Good |
| | 13 | SUS304 | 3 | 1200 | 30 | 1100 | 10 | 50 | 600 | A | Good (0.18) | Good |
| | 14 | SUS304 | 3 | 1100 | 10 | 1100 | 10 | 50 | 600 | A | Good (0.09) | Good |
| | 15 | SU5304 | 3 | 1100 | 20 | 1100 | 10 | 50 | 600 | A | Good (0.10) | Good |
| | 16 | SUS304 | 3 | 1100 | 50 | 1100 | 10 | 50 | 600 | A | Good (0.08) | Good |
| | 17 | SUS304 | 3 | 1100 | 30 | 900 | 10 | 50 | 600 | A | Good (0.18) | Good |
| | 18 | SUS304 | 3 | 1100 | 30 | 1000 | 10 | 50 | 600 | A | Good (0.07) | Good |
| | 19 | SUS304 | 3 | 1100 | 30 | 1200 | 10 | 50 | 600 | A | Good (0.17) | Good |
| | 20 | SUS304 | 3 | 1100 | 30 | 1100 | 5 | 50 | 600 | A | Good (0.10) | Good |
| | 21 | SUS304 | 3 | 1100 | 30 | 1100 | 20 | 50 | 600 | A | Good (0.09) | Good |
| | 22 | SUS304 | 3 | 1100 | 30 | 1100 | 10 | 20 | 600 | A | Good (0.09) | Good |
| | 23 | SUS304 | 3 | 1100 | 30 | 1100 | 10 | 200 | 600 | A | Good (0.09) | Good |
| | 24 | SUS304 | 3 | 1100 | 30 | 1100 | 10 | 50 | 400 | A | Good (0.09) | Good |
| | 25 | SUS304 | 3 | 1100 | 30 | 1100 | 10 | 50 | 500 | A | Good (0.10) | Good |
| | 26 | SUS304 | 3 | 1100 | 30 | 1100 | 10 | 50 | 600 | B | Good (0.08) | Good |
| Comp. process | 27 | SUS304 | 12 | 1100 | 30 | 1100 | 10 | 50 | 600 | A | Failure (0.35) | Good |
| | 28 | SUS304 | 3 | 850 | 30 | 1100 | 10 | 50 | 600 | A | Failure (0.42) | Good |
| | 29 | SUS304 | 3 | 1250 | 30 | 1100 | 10 | 50 | 600 | A | Failure (0.36) | Good |
| | 30 | SUS304 | 3 | 1100 | 5 | 1100 | 10 | 50 | 600 | A | Failure (0.25) | Good |
| | 31 | SUS304 | 3 | 1100 | 30 | 850 | 10 | 50 | 600 | A | Failure (0.45) | Good |
| | 32 | SUS304 | 3 | 1100 | 30 | 1250 | 10 | 50 | 600 | A | Failure (0.42) | Failure (Scab) |
| | 33 | SUS304 | 3 | 1100 | 30 | 1100 | 2 | 50 | 600 | A | Failure (0.56) | Good |
| | 34 | SUS304 | 3 | 1100 | 30 | 1100 | 10 | 10 | 600 | A | Good (0.10) | Failure (Micro-group) |
| | 35 | SUS304 | 3 | 1100 | 30 | 1100 | 10 | 50 | 700 | A | Good (0.10) | Failure (Micro-group) |

Note 1)
In the step A, the steel strip was descaled, cold-rolled, annealed, and pickled to prepare a sheet product.
In the step B, the steel strip was descaled, cold-rolled, annealed, pickled, and temper-rolled to prepare a sheet product.

EXAMPLE 2

Cr-Ni stainless steel (comprising not less than 8% of Cr and not less than 13% of Ni with the balance consisting of Fe) strips having a thickness of 2 to 3 mm were produced using a twin-drum continuous casting machine/hot-rolling machine equipment array as shown in FIG. 7. During continuous casting (during flying), the thickness of the thin strip-like slab was changed, and the resultant stainless steel strips were subjected to pickling/cold rolling or annealing/pickling to provide stainless steel strip products of which the quality was then evaluated. The results, together with operation conditions, are summarized in Table 2. In this connection, it should be noted that, the description of conditions for pickling/cold rolling and annealing/picking was omitted because the conditions were conventional.

As shown in Table 2, for all the samples wherein, according to the present invention, the casting arc angle was decreased to 30°, i.e., 10° smaller than the conventional level, with the thickness of cast strips being decreased, no roping was observed and, at the same time, the luster was even, so that the products were satisfactory.

By contrast, for samples wherein the thickness of the cast strip was reduced during flying while maintaining the casting arc angle at 40°, the conventional level, roping was evidently created and, in addition, the luster was uneven, so that the products were unsatisfactory.

Further, for all the samples falling within the scope of the present invention wherein the casting arc angle was decreased to 30°, i.e., 10° smaller than the conventional level, with the thickness of cast strips being increased, no roping was observed and, at the same time, the luster was even, so that the products were satisfactory.

By contrast, for comparative samples wherein the thickness of the cast strip was increased during flying while maintaining the casting arc angle at 40°, the ordinary level, roping was evidently created and, in addition, the luster was uneven, so that the products were unsatisfactory.

TABLE 2

| | | | | Before change of gauge | | | | | | After change of gauge | | | | | | | |
|---|---|---|---|---|---|---|---|---|---|---|---|---|---|---|---|---|---|
| | | | | Casting arc angle (40° C.) | | | Casting arc angle (30° C.) | | | Casting arc angle (30° C.) | | | Casting arc angle (40° C.) | | | | |
| | | Thickness of product sheet | | | Length of heat-treating furnace | Length | | Length of heat-treating furnance | Length | | Length of heat-treating furnance | Length | | Length of heat-treating furnance | Length | | |
| | Change | Before change (mm) | After change (mm) | Casting speed (mm) | Speed at furnace inlet | of cooled strip (m) | Casting speed (mm) | Speed at furnace inlet | of cooled strip (m) | Casting speed (mm) | Speed at furance inlet | of cooled strip (m) | Casting speed (mm) | Speed at furnace inlet | of cooled strip (m) | Roping | Luster |
| Process using inv. | Decrease in thickness | 3.5 | 3.0 | 28.5 | 18.4 m 890° C. | 6.4 | 21.4 | 13.8 m 820° C. | 5.2 | 28.4 | 17.5 m 886° C. | 6.0 | 37.9 | 18.2 m 948° C. | 7.2 | ○ | ○ |
| | | 3.0 | 2.5 | 37.9 | 18.2 m 948° C. | 7.2 | 28.4 | 14.6 m 886° C. | 6.0 | 40.0 | 16.8 m 938° C. | 6.8 | 53.3 | 15.6 m 886° C. | 8.4 | ○ | ○ |
| | | 2.5 | 2.0 | 53.3 | 15.6 m 996° C. | 8.4 | 40.0 | 12.5 m 931° C. | 6.4 | 60.6 | 12.8 m 1030° C. | 7.6 | 80.7 | 15.2 m 1060° C. | 9.2 | ○ | ○ |
| | Increase in thickness | 2.5 | 3.0 | 53.3 | 15.6 m 996° C. | 8.4 | | | | | | | 37.9 | 18.2 m 948° C. | 7.2 | ○ | ○ |
| | | 2.0 | 2.5 | 80.7 | 15.2 m 1060° C. | 9.2 | | | | | | | 53.3 | 15.6 m 996° C. | 8.4 | ○ | ○ |
| | | | | | | | | | | | | | 53.3 | 15.8 m 996° C. | 8.4 | Δ | Δ |
| Conventional process | Decrease in thickness | 3.0 | 2.5 | 37.9 | 18.2 m 948° C. | 7.2 | | | | | | | 80.7 | 15.2 m 1060° C. | 9.2 | Δ | Δ |
| | | 2.5 | 2.0 | 53.3 | 15.6 m 998° C. | 8.4 | | | | | | | | | | | |

Industrial Applicability

According to the apparatus of the present invention, cold-rolled steel sheets having good surface quality without significant roping can be produced, and, in particular, even when the casting thickness is changed during casting, hot-rolling conditions and hot treatment conditions can be varied according to this change, it is possible to provide steel sheet products having excellent surface quality. Further, when the strip thickness is changed to a smaller one, there is no need to increase the length of the furnace in a transition period for changing the thickness, enabling the length of the furnace to be shortened. Furthermore, the yield of the strip in its portion where the thickness has been changed during flying is not lowered, so that the strip in that portion can be brought to a product as that produced in a steady state. Furthermore, the adoption of a direct fire burner in a heat-treating furnace enables energy savings. Furthermore, carrier rolls in the heat-treating furnace may be rendered liftable so that, in the conveyance of a strip after conveyance of a dummy sheet, some of carrier rolls can be refuged so as not to come into contact with the strip, reducing the opportunity to create a build-up defect. Furthermore, cooling of carrier rolls within the heat-treating furnace by circulating a cooling gas can prevent the separation of a sprayed deposit, of ceramic or the like formed on the roll surface and the creation of build-up defects.

Thus, the present invention is very advantageous in an industrial viewpoint in the field of production of stainless steel sheet products.

We claim:

1. An apparatus for producing a strip of a stainless steel, comprising the following devices arranged in sequence:

a twin-drum continuous casting machine for casting a molten stainless steel into a thin strip-like slab having a thickness of not less than 10 mm;

an atmosphere control cover which cuts off an atmosphere in a carrier zone extending from the continuous casting machine to a hot-rolling machine and, at the same time, has in its interior a bridle roll or a pinch roll for regulating the tension of the strip being carried;

a hot-rolling machine for rolling the strip with a reduction ratio of not less than 10%;

a heat-treating furnace equipped with a heating device for either heating the hot-rolled strip and holding the temperature of the hot-rolled strip or holding the temperature of the hot-rolled strip;

a cooling device for cooling the strip heat-treated in the heat-treating furnace at a rate of not less than 10° C./sec; and a coiler for coiling the strip cooled in the cooling device.

2. The apparatus according to claim 1, wherein the bridle roll is provided within the atmosphere control cover which cuts off the atmosphere of the carrier zone, heat-holding covers are provided between the hot-rolling machine and the heat-treating furnace, and a strip thickness meter is provided between the heat-holding covers.

3. The apparatus according to claim 1, wherein two sets of pinch rolls are disposed within the atmosphere control cover for cutting off the atmosphere of the carrier zone and a thin strip-like slab thickness meter is provided between the two sets of pinch rolls.

4. The apparatus according to claim 1, wherein direct fire burners are provided so as to sandwich therebetween the strip, being carried by the carrier roll in the furnace, respectively on an upper wall and a lower wall of the furnace in such a manner that a flame is sprayed through the burners directly onto both sides of the strip.

5. The apparatus according to claim 1, wherein the heat-treating furnace is partitioned in a longitudinal direction to provide a plurality of partition zones with a direct fire heater located in each partition zone in a manner so as to sandwich therebetween the strip, and which further comprises: a combustion control and computation device which inputs the strip temperature tc at heat-treating furnace inlet, the strip temperature t at zone outlet or heat-treating furnace outlet, the strip thickness h at heat-treating furnace inlet, and the travel speed v of the strip at heat-treating furnace inlet, performs computation, and transmits a command based on the results of computation to a burner combustion control device; a burner combustion control device which, based on the command, controls a combustion gas flow control valve in each zone; and a combustion gas flow control valve which is controlled by the burner combustion control device to control the flow rate of the combustion gas.

6. The apparatus according to claim 1, wherein the side wall of the heat-treating furnace is partitioned in a longitudinal direction into a lower wall section, provided with a carrier roll, and an upper wall section, the inner surface of the upper wall section and the outer surface of the lower section are tapered so that the upper wall section is descendable to permit the heat-treating furnace to be sealed with the aid of both the inner surface of the upper wall section and the outer surface of the lower section, a lifting actuator is provided in the upper wall section, and direct fire burners are connected to a flexible hose.

7. The apparatus according to claim 1, wherein a heating device is disposed on the atmosphere control cover to provide heat to said carrier zone.

8. The apparatus according to claim 7, wherein a circulation type gas cooler for bringing a cooling gas into contact with the circumferential surface of the carrier roll and circulating the gas is provided in part or all of the carrier rolls provided within the heat-treating furnace.

9. The apparatus according to claim 1, wherein the hot-rolling machine is surrounded by the atmosphere cover.

10. The apparatus for producing a strip of a stainless steel, comprising a heat-treating furnace for at least holding a temperature of a strip cast by means of a twin-drum continuous casting machine, characterized in that at least a portion of carrier rolls within the heat-treating furnace are movably mounted and connected to a lifting device means for bring said movably mounted carrier rolls selectively into contact with and away from contact with said strip moving through said heat-treating furnace, and direct fire burners are provided so as to sandwich therebetween the strip, being carried by the carrier rolls in the furnace, respectively on an upper wall and a lower wall of the heat-treating furnace in such a manner that a flame is ejected through the direct fire burners directly onto both sides of the strip.

* * * * *